US008667828B2

(12) United States Patent
Maeda et al.

(10) Patent No.: US 8,667,828 B2
(45) Date of Patent: Mar. 11, 2014

(54) CRANKSHAFT PRODUCTION METHOD AND PRODUCTION APPARATUS

(75) Inventors: Osamu Maeda, Toyota (JP); Keiichi Matsunaga, Anjo (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 932 days.

(21) Appl. No.: 12/689,412

(22) Filed: Jan. 19, 2010

(65) Prior Publication Data

US 2010/0180658 A1 Jul. 22, 2010

(30) Foreign Application Priority Data

Jan. 19, 2009 (JP) ..... 2009-008771

(51) Int. Cl.
*B21D 22/00* (2006.01)

(52) U.S. Cl.
USPC ..... 72/353.2; 72/356; 72/361

(58) Field of Classification Search
USPC ..... 72/361, 354.2, 354.6, 354.8, 355.2, 72/353.2, 355.6, 357, 360, 352, 356, 412, 72/472; 29/888.08
See application file for complete search history.

(56) References Cited

U.S. PATENT DOCUMENTS

| | | | | |
|---|---|---|---|---|
| 4,517,717 | A * | 5/1985 | Gentry | 29/888.08 |
| 5,115,663 | A * | 5/1992 | Ando et al. | 29/888.08 |
| 2007/0056345 | A1* | 3/2007 | Otaki | 72/353.2 |

FOREIGN PATENT DOCUMENTS

| | | | |
|---|---|---|---|
| CN | 101257984 | A | 9/2008 |
| JP | 49-106949 | A | 9/1974 |
| JP | 07-112232 | A | 5/1995 |
| JP | 2005-009595 | A | 1/2005 |

* cited by examiner

*Primary Examiner* — Dana Ross
*Assistant Examiner* — Mohammad I Yusuf
(74) *Attorney, Agent, or Firm* — Kenyon & Kenyon LLP

(57) ABSTRACT

A crankshaft production method includes: pressurizing both end portions of a shaft blank with a pressurization surface of a die, the pressurization surface being inclined in a specific direction so as to come close to the other end side of the shaft blank, and applying an axial compressive load to the shaft blank, while restricting a radial deformation in a predetermined zone of the shaft blank in a direction other than the specific direction, thereby swaging the shaft blank and causing the predetermined zone to buckle in the specific direction.

5 Claims, 35 Drawing Sheets

INITIAL STATE

INITIAL STATE
BUCKLING PROCESS
SWAGING PROCESS
ECCENTRIC SWAGING COMPLETION
1
6
6a
7
7a
8
10
10a
14
D1
L1
Ld
LP
SD

AFTER SHAPING IS STARTED

INITIAL STATE

AFTER SHAPING IS STARTED

BUCKLING PROCESS

INITIAL STATE

AFTER SHAPING IS STARTED

BUCKLING PROCESS

INITIAL STATE

BUCKLING PROCESS

SWAGING PROCESS

INITIAL STATE

LATTER HALF OF ECCENTRIC SWAGING

INITIAL STATE

LATTER HALF OF ECCENTRIC SWAGING

AFTER SHAPING IS STARTED

AFTER SHAPING

CRANKSHAFT PRODUCTION METHOD AND PRODUCTION APPARATUS

INCORPORATION BY REFERENCE

The disclosure of Japanese Patent Application No. 2009-008771 filed on Jan. 19, 2009 including the specification, drawings and abstract is incorporated herein by reference in its entirety.

BACKGROUND OF THE INVENTION

1. Field of the Invention

The invention relates to a crankshaft production method and production apparatus for producing a crankshaft from a shaft blank.

2. Description of the Related Art

Japanese Patent Application Publication No. 49-106949 (JP-A-49-106949) describes, as a conventional technique of the aforementioned type, a technique for producing a crankshaft by the so-called "eccentric swaging-forging" by which the upper and lower end portions of a rod material (shaft blank) are pressed, while an intermediate portion of the shaft blank is caused to slide in the direction perpendicular to the axial line, and the shaft blank is swaged, while being budded. More specifically, as shown in a schematic cross-sectional view in FIG. 58, the production apparatus includes an upper block 61 provided movably in the vertical direction, a lower block 62 that is provided immovably in a transverse direction, and an intermediate block 63 that is provided in an intermediate position between the upper and lower blocks 61, 62. An intermediate portion of a shaft blank 64 is gripped by the intermediate block 63, swaging portions are formed above and below the intermediate portion, and the swaging portions are then buckled by applying a pressure and lowering the upper block 61 and also sliding the intermediate block 63 in the transverse direction, while lowering the intermediate block, in connection with the aforementioned operation. As a result, the swaging portions are pressurized between the upper block 61 and the intermediate block 63 and between the intermediate block 63 and the lower block 62.

Shaping a crankshaft in a cold forging mode by the above-described "eccentric swaging-forging" enables net shaping of the crankshaft and makes it possible to expect a reduction of thermal strains, a decrease in the number of machining steps necessary to produce the crankshaft, and a reduction of crankshaft production cost. In this case, in order to increase the variation of engine exhaust gas amount, it is necessary to vary the eccentricity amount of a pin portion, that is, the offset amount between a journal portion and a pin portion, in the production of a crankshaft by the "eccentric swaging-forging". Increasing the eccentric amount of the pin portion is particularly technologically difficult.

With the technique described in JP-A-49-106949, the shaft blank has to be compressed in the axial direction, while applying a force that induces sliding in the intermediate portion of the shaft blank, in order to control the buckling direction of swaging portions. In this case, buckling of the shaft can be ahead of swaging and shear cracking can occur in the shaft blank in the buckling process. Further, where the offset amount between the journal portion and pin portion of the crankshaft increases to ensure the variation of the engine exhaust gas amount, shear cracking can occur in the shaft blank in the latter half of swaging. FIG. 59 is an enlarged cross-sectional view of the zone inside a dash line circle S9 in FIG. 58. As shown in FIG. 59, a clearance C1 of for example about "5 to 20 μm" is required between the upper end portion of the shaft blank 64 and a receiving orifice 61*a* of the upper block 61. However, after the shaping of the crankshaft has been started, as shown in FIG. 60, the shaft blank 64 shifts to one side through the clearance C1. Therefore, a load in the vertical direction cannot be efficiently applied as a compressive force to the shaft blank 64. As a result, where the eccentricity amount of the shaft blank 64 increases, the tensile stress of the arm portion of the crankshaft increases and a crack 66 can occur in a shaped article 65, as shown in a cross-sectional view in FIG. 61.

SUMMARY OF THE INVENTION

The invention provides a crankshaft production method and production apparatus that make it possible to inhibit cracking of a shaft blank in eccentric swaging-forging.

A crankshaft production method according to the first aspect of the invention includes pressurizing both end portions of a shaft blank with a pressurization surface of a die, the pressurization surface being inclined in a specific direction so as to come close to the other end side of the shaft blank, and applying an axial compressive load to the shaft blank, while restricting a radial deformation in a predetermined zone of the shaft blank in a direction other than the specific direction, thereby swaging the shaft blank and causing the predetermined zone to buckle in the specific direction.

According to the first aspect, when both ends of the shaft blank are pressurized by the die, the end surface of the shaft blank is pressurized by the inclined pressurization surface, whereby a compressive load is applied to the shaft blank, such that prevents the buckling from being ahead of swaging. As a result, an excessive advance of budding is suppressed and the occurrence of excessive tensile stresses in the shaft blank is inhibited. Therefore, the occurrence of shear cracking in the shaft blank under the effect of buckling in the course of eccentric swaging-forging can be inhibited.

In the production method according to the first aspect, the die may include a receiving orifice that receives an end portion of the shaft blank, the inclined pressurization surface may be formed in a bottom portion of the receiving orifice, a circumferential groove may be formed along a circumference of the bottom portion, and when the end portion of the shaft blank is inserted into the receiving orifice and both end portions of the shaft blank are pressurized by the die, the material of the end portion of the shaft blank may be caused to expand into the circumferential groove.

With such a configuration, when the end portion of the shaft blank is inserted into the receiving orifice and both end portions of the shaft blank are pressurized by the die, the material of the end portion of the shaft blank is caused to expand into the circumferential groove. Therefore, a compressive load acting upon the shaft blank at the initial stage of shaping is increased. Further, cracking of the shaft blank at the initial stage of shaping can be inhibited.

In the production method according to the first aspect, the die may include a receiving orifice that receives an end portion of the shaft blank, an opening edge of the receiving orifice may be formed in a circular-arc shape, and when the end portion of the shaft blank is inserted into the receiving orifice and both end portions of the shaft blank are pressurized by the die, the shaft blank may be caused to deform according to the circular-arc opening edge.

With such a configuration, when the end portion of the shaft blank is inserted into the receiving orifice and both end portions of the shaft blank are pressurized by the die, the shaft blank is caused to deform according to the circular-arc opening edge. Therefore, cracking in the outer side of the buckled portion of the shaft blank can be inhibited.

The crankshaft production method according to the second aspect of the invention includes pressurizing both end portions of a shaft blank with a die to apply an axial compressive load to the shaft blank while restricting a radial deformation in a predetermined zone of the shaft blank in a direction other than a specific direction, and pressurizing the predetermined zone with an inclined portion provided in at least part of a bottom surface of the die, the inclined portion being inclined in the specific direction so as to come close to the other end side of the shaft blank, thereby swaging the shaft blank and causing the predetermined zone to buckle in the specific direction.

According to the second aspect, when the surfaces of the shaft blank that will be buckled are pressurized by the bottom surface of the die, because the pressurization is conducted by the inclined portion, a compressive load is applied to the shaft blank, such that the slip between the surfaces of the shaft blank that will be buckled and the bottom surface of the die is inhibited. As a result, the occurrence of tensile stresses and shear stresses at the surface of the shaft blank is inhibited. Therefore, cracking of the surface of the shaft blank caused by swaging in the eccentric swaging-forging process can be inhibited.

In the production method according to the second aspect, the die may include a receiving orifice that receives an end portion of the shaft blank, a portion with increased surface roughness may be provided at the bottom surface of the die concentrically around the receiving orifice, and the predetermined zone may be pressurized by the portion with increased surface roughness.

With the above-described configuration, when the surfaces of the shaft blank that will be buckled are pressurized by the bottom surface of the die, because the pressurization is conducted by the portion with increased surface roughness, a compressive load is applied to the shaft blank, such that the slip between the surfaces of the shaft blank that will be buckled and the bottom surface of the die is inhibited. As a result, the occurrence of local tensile stresses and shear stresses at the surface of the shaft blank is inhibited. Therefore, local cracking of the surface of the shaft blank caused by swaging in the eccentric swaging-forging process can be inhibited.

The crankshaft production apparatus according to the third aspect of the invention includes a first die that applies an axial compressive load to a shaft blank, is provided at one end side of the shaft blank, and includes a pressurization surface that pressurizes an end surface of the shaft blank, wherein the pressurization surface is inclined in a specific direction so as to come close to the other end side of the shaft blank; a second die that applies an axial compressive load to the shaft blank, is provided at the other end side of the shaft blank, and includes a pressurization surface that pressurizes an end surface of the shaft blank, wherein the pressurization surface is inclined in the specific direction so as to come close to one end side of the shaft blank; a third die installed on the shaft blank; a holding member that holds the third die in a predetermined zone on the shaft blank; and a movement restricting unit that restricts a movement of the holding member in a radial direction of the shaft blank together with the third die in a direction other than the specific direction.

According to the third aspect, when both ends of the shaft blank are pressurized by the first die and the second die, the end surfaces of the shaft blank are pressurized by the inclined pressurization surfaces a compressive load is applied to the shaft blank, such that prevents the buckling from being ahead of swaging, an excessive advance of buckling is suppressed, and the occurrence of excessive tensile stresses in the shaft blank is inhibited. Therefore, the occurrence of shear cracking in the shaft blank under the effect of buckling in the course of eccentric swaging-forging can be inhibited.

In the production apparatus according to the third aspect, the first die and the second die each may include a receiving orifice that receives an end portion of the shaft blank, the inclined pressurization surface may be formed in a bottom portion of the receiving orifice, and a circumferential groove may be formed along a circumference of the bottom portion.

With such a configuration, when both ends of the shaft blank are inserted into the receiving orifices of the first die and the second die and both end portions of the shaft blank are pressurized by the first die and the second die, the material of the end portion of the shaft blank is caused to expand into the circumferential groove and a compressive load acting upon the shaft blank at the initial stage of shaping is increased. Further, cracking of the shaft blank at the initial stage of shaping can be inhibited.

In the production apparatus according to the third aspect, the first die and the second die each may include a receiving orifice that receives an end portion of the shaft blank, and an opening edge of the receiving orifice may be formed in a circular arc shape.

With such a configuration, because both end portions of the shaft blank are inserted into the receiving orifices of the first die and the second die and both end portions of the shaft blank are pressurized by the first die and the second die, the shaft blank is deformed according to the circular-arc opening edge of the receiving orifice and the occurrence of excessively large tensile stresses on the outside of the buckled portion of the shaft blank is inhibited. Therefore, creaking outside the buckled portion of the shaft blank can be inhibited.

The crankshaft production apparatus according to the fourth aspect of the invention includes: a first die that applies an axial compressive load to the shaft blank, is provided at one end side of a shaft blank, and includes an inclined portion that is provided in at least part of a bottom surface thereof and is inclined in a specific direction so as to come close to the other end side of the shaft blank; a second die that applies an axial compressive load to the shaft blank, is provided at the other end side of the shaft blank, and includes an inclined portion that is provided in at least part of a bottom surface thereof and is inclined in a specific direction so as to come close to one end side of the shaft blank; a third die installed on the shaft blank; a holding member that holds the third die in a predetermined zone on the shaft blank; and a movement restricting unit for restricting a movement of the holding member in a radial direction of the shaft blank together with the third die in a direction other than the specific direction.

With the production apparatus according to the fourth aspect, because the surfaces of the shaft blank that will be buckled are pressurized by the respective bottom surfaces of the first die and the second die, the surfaces of the shaft blank are pressurized by the inclined portions of the bottom surfaces of the dies and a compressive load is applied to the shaft blank such that inhibits the slip between the bottom surfaces the dies and the surfaces of the shaft blank. As a result, the occurrence of tensile stresses and shear stresses in the surface of the shaft blank is inhibited. Therefore, cracking of the shaft blank surface caused by swaging in eccentric swaging-forging can be inhibited.

In the production apparatus according to the fourth aspect, the first die and the second die each may include a receiving orifice that receives an end portion of the shaft blank, and a portion with increased surface roughness may be provided at the bottom surface of each of the first die and the second die concentrically around the receiving orifice.

With such a configuration, because the surface of the shaft blank that will be budded is pressurized by the bottom surfaces of the first die and the second die, the surface of the shaft blank is pressurized by the portion with increased surface roughness and a compressive load is applied to the shaft blank, such that inhibits the slip between the surface of the shaft blank that will be buckled and the bottom surfaces of the dies. As a result, the occurrence of local tensile stresses and shear stresses at the surface of the shaft blank is inhibited. Therefore, local cracking of the surface of the shaft blank can be inhibited.

BRIEF DESCRIPTION OF THE DRAWINGS

The foregoing and further objects, features and advantages of the invention will become apparent from the following description of example embodiments with reference to the accompanying drawings wherein line numerals are used to represent like elements and wherein:

FIGS. 15A to 15 D each show a cross-sectional view illustrating in a simple manner a series of operations of the production method in the first embodiment;

FIG. 56A is a side cross-sectional view showing a pushing die; FIG. 56B is a bottom view showing a pushing die;

DETAILED DESCRIPTION OF EMBODIMENTS

First Embodiment

The first specific embodiment of the crankshaft production method and production apparatus in accordance with the invention will be explained below in details with reference to the appended drawings.

A basic configuration of the crankshaft production method and production apparatus of the first embodiment will be explained below. Specific constituent portions in the first embodiment will be described later.

Figure 1:
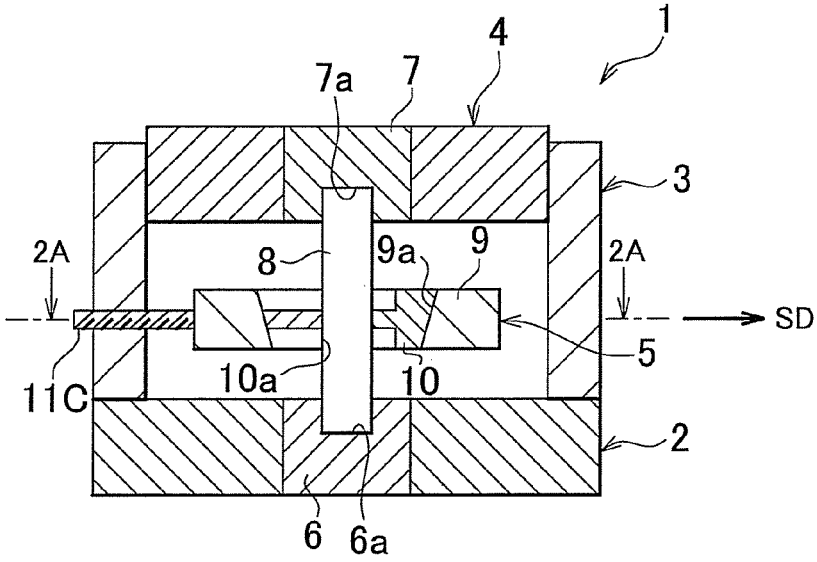
FIG. 1 is a vertical sectional view illustrating a basic configuration of the production apparatus in the first embodiment.
Figure 2:
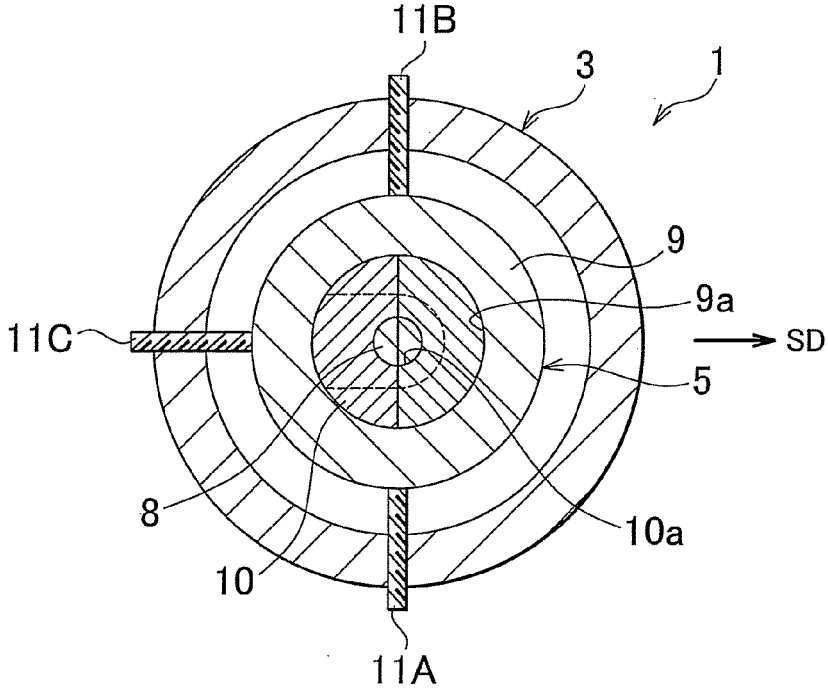
FIG. 2 is a sectional view along the 2A-2A line in FIG. 1 that illustrates a basic configuration of the production apparatus in the first embodiment.

FIG. 1 is a vertical sectional view illustrating a basic configuration of a crankshaft production apparatus 1. FIG. 2 is a sectional view (cross-sectional view) along the 2A-2A line in FIG. 1 that illustrates the basic configuration of the production apparatus 1. The production apparatus 1 includes a fixed jig 2 serving as a platform, a guiding jig 3 provided vertically on the fixed jig 2, a pushing jig 4 that is provided to be vertically movable along an inner periphery of the guiding jig 3, and a floating jig 5 disposed between the fixed jig 2 and the pushing jig 4 on the inside of the guiding jig 3.

The fixed jig 2 includes a fixed die 6 in the center thereof. A receiving orifice 6*a* is foamed in an upper surface of the fixed die 6. The guiding jig 3 has a cylindrical shape. The pushing jig 4 includes a pushing die 7 in the center thereof. A receiving orifice 7*a* is formed in a lower surface of the pushing die 7. As shown in FIG. 1, in the production apparatus 1, a shaft blank 8 is supported vertically between the fixed jig 2 and the pushing jig 4 by inserting the upper and lower ends of the shaft blank 8 into the receiving orifice 6*a* of the fixed die 6 and the receiving orifice 7*a* of the pushing die 7. The pushing jig 4 can be moved reciprocatingly in the vertical direction by a predetermined hydraulic device including a hydraulic cylinder.

The floating jig 5 includes an annular member 9 and a floating die 10 positioned in the center of the annular member 9. The floating die 10 cross section has an inverted trapezoidal shape and the outer circumference thereof is a tapered surface. A hole 10*a* for inserting the shaft blank 8 is formed in the center of the floating die 10. A tapered hole 9*a* matching the tapered surface of the outer circumference of the floating die 10 is formed in the center of the annular member 9. As shown in FIG. 1, the floating jig 5 is held in an intermediate zone on the shaft blank 8. In a state in which the floating die 10 is set in the intermediate zone on the shaft blank 8, the outer circumferential surface of the floating die 10 is pressed in the tapered hole 9*a* of the annular member 9 and the annular member 9 is pressed against the outer circumference of the floating die 10. As a result, the floating die 10 is fastened tightly by the annular member 9 and held in the intermediate zone on the shaft blank 8. In the first embodiment, the annular member 9 functions as a holding member in accordance with the invention, and the intermediate location of the shaft blank 8 functions as a predetermined location in accordance with the invention. As shown in FIG. 1, in the first embodiment, the floating jig 5 is held in the intermediate position of the fixing jig 2 and pushing jig 4 by setting the shaft blank 8 together with the floating jig 5 in the production apparatus 1.

As shown in FIGS. 1 and 2, three bolts 11A to 11C are provided in the guiding jig 3 and pass through the guiding jig 3 so as to position the shaft blank 8 radially in the center. The tips of the three bolts 11A to 11C can come into contact with the outer circumference of the annular member 9 constituting the floating jig 5. As shown in FIG. 2, the two bolts 11A and 11B from among the three bolts 11A to 11C are disposed in mutually opposing positions with the shaft blank 8 being interposed therebetween, and the tips of these two bolts face the center of the shaft blank 8. The remaining one bolt 11C is disposed between the two bolts 11A and 11B and the tip thereof faces the center of the shaft blank 8. In the first embodiment, a direction (direction to the right in FIG. 2) on the side opposite the position of the remaining one bolt 11C, with the shaft blank 8 being disposed therebetween, is a specific direction SD. In the first embodiment, the guiding jig 3 and three bolts 11A to 11C function as a movement restricting portion in accordance with the invention for restricting the movement of the floating jig 5 in any radial direction of the shaft blank 8 other than the specific direction SD.

Figure 3:
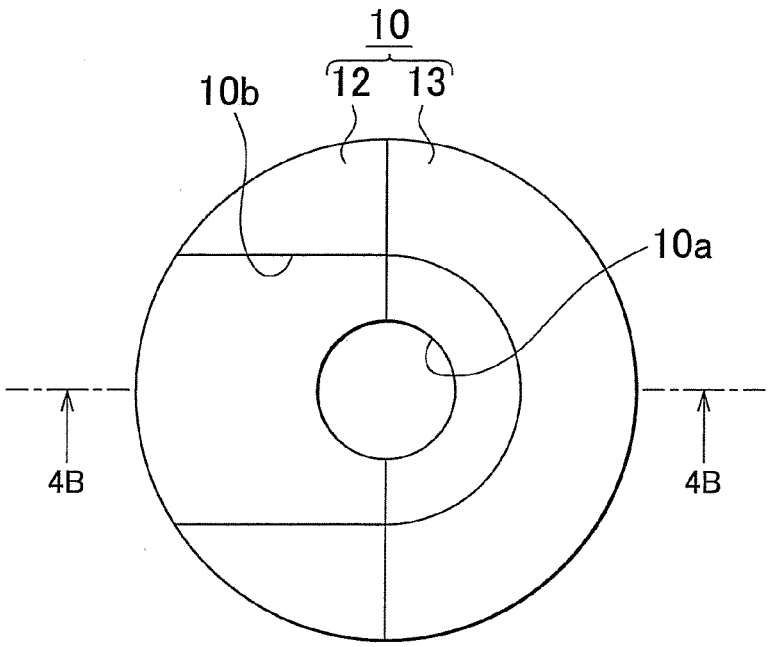
FIG. 3 is a plan view illustrating a floating die in the first embodiment.
Figure 4:
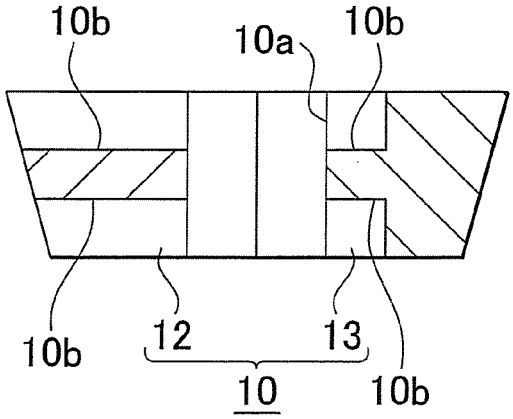
FIG. 4 is a sectional view along the 4B-4B line in FIG. 3 that illustrates the floating die in the first embodiment.
Figure 5:
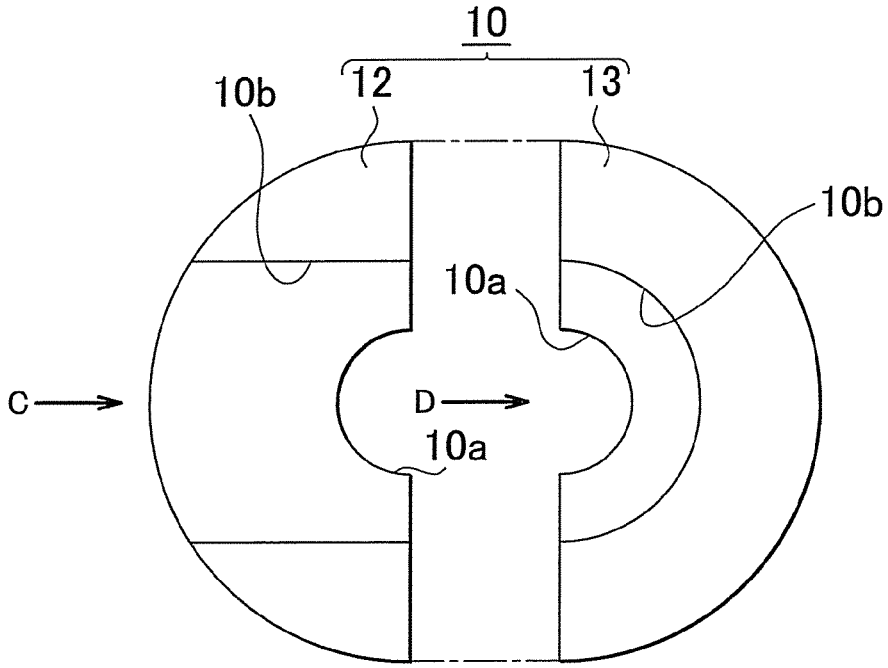
FIG. 5 is a plan view of the floating die disjointed into two split pieces in the first embodiment.
Figure 6:
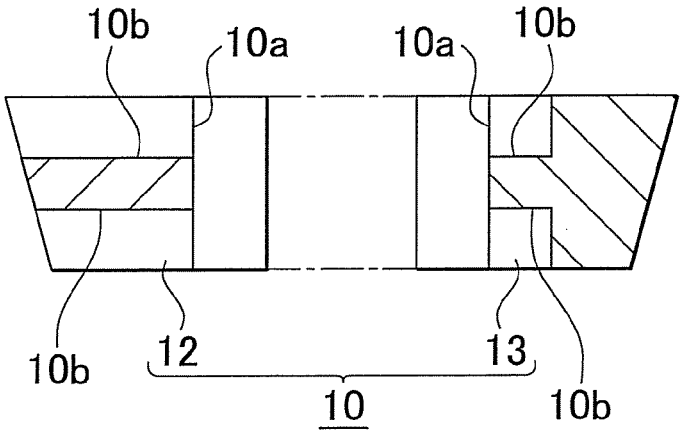
FIG. 6 is a cross-sectional view of the floating die disjointed into two split pieces in the first embodiment.
Figure 7:
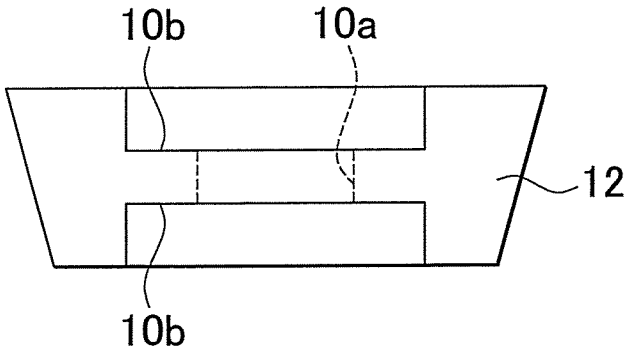
FIG. 7 is a plan view of one split piece, as viewed from the direction of arrow C in FIG. 5 in the first embodiment.
Figure 8:
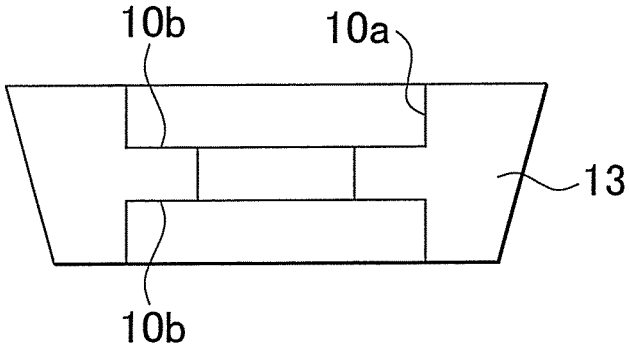
FIG. 8 is a plan view of one split piece, as viewed from the direction of arrow D in FIG. 5 in the first embodiment.

The floating die 10 will be described below in greater detail. FIG. 3 is a plan view of the floating die 10. FIG. 4 is a sectional view of the floating die 10 along the 4B-4B line in FIG. 3. FIG. 5 is a plan view of the floating die 10 disjointed into two split pieces 12, 13. FIG. 6 is a cross-sectional view of the floating die 10 disjointed into two split pieces 12, 13. FIG. 7 is a plan view of one split piece 12, as viewed from the direction of arrow C in FIG. 5. FIG. 8 is a plan view of the other split piece 13, as viewed from the direction of arrow D in FIG. 5. As shown in FIGS. 3 to 6, the floating die 10 is configured to be splittable into two by two split pieces 12, 13. A U-shaped recess 10*b* is provided about the central hole 10*a* as a center at the upper surface side of the floating die 10. In the first split piece 12 (on the left side in the figure), the recess 10*b* is opened at the outer circumferential edge thereof, whereas in the second split piece 13 (on the right side in the figure), the recess has a circular arc shape along the hole 10*a* and is not open at the outer circumferential edge. A recess 10*b* identical to the recess at the upper surface side is also provided at the lower surface side of the floating die 10. As will be described below, the recess 10*b* receives part of the shaft blank 8 and allows the shaft blank 8 to be shaped to the predetermined shape when the shaft blank 8 is buckled.

Figure 9:
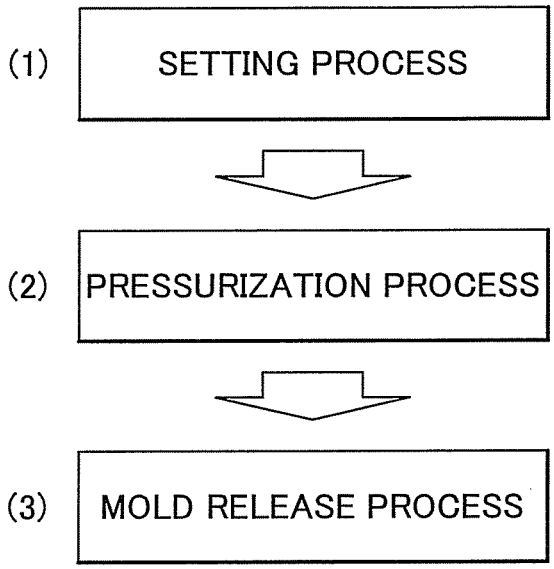
FIG. 9 is a flowchart illustrating a crankshaft production method in the first embodiment.

A basic configuration of the crankshaft production method conducted using the above-described production apparatus 1 will be described below. The production method is shown in FIG. 9 by a flowchart. Each process of the production method is shown in FIGS. 10 to 13 by vertical cross-sectional views of the basic configuration of the production apparatus 1. The explanation below will follow the numbers assigned to the flowchart in FIG. 9.

Figure 10:
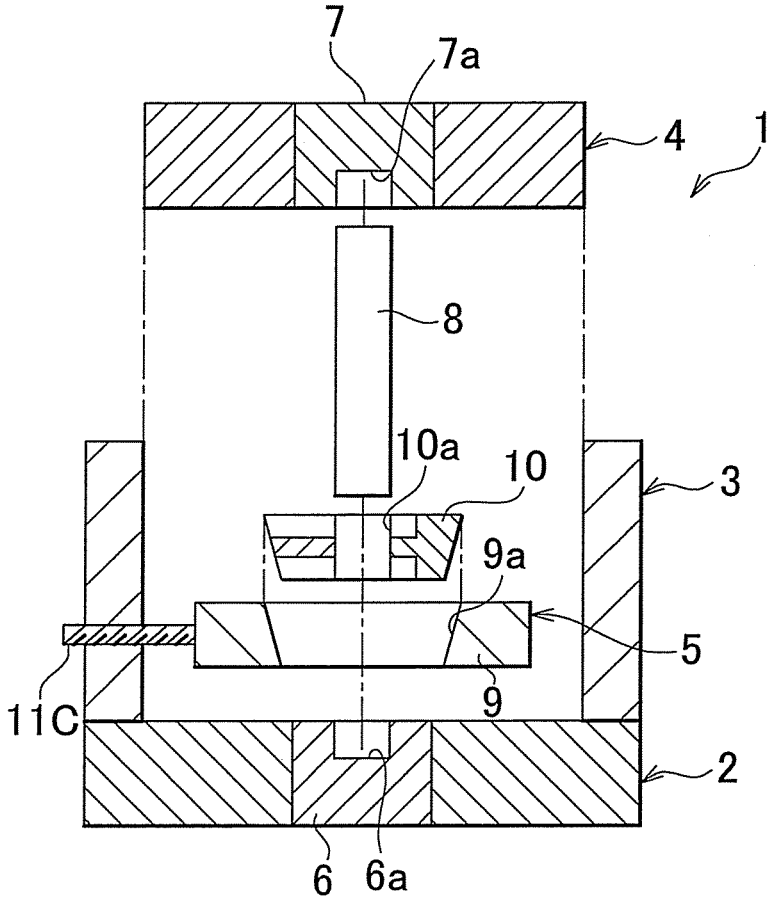
FIG. 10 is a vertical sectional view of the production apparatus in a disassembled state in the setting process in the first embodiment.
Figure 11:
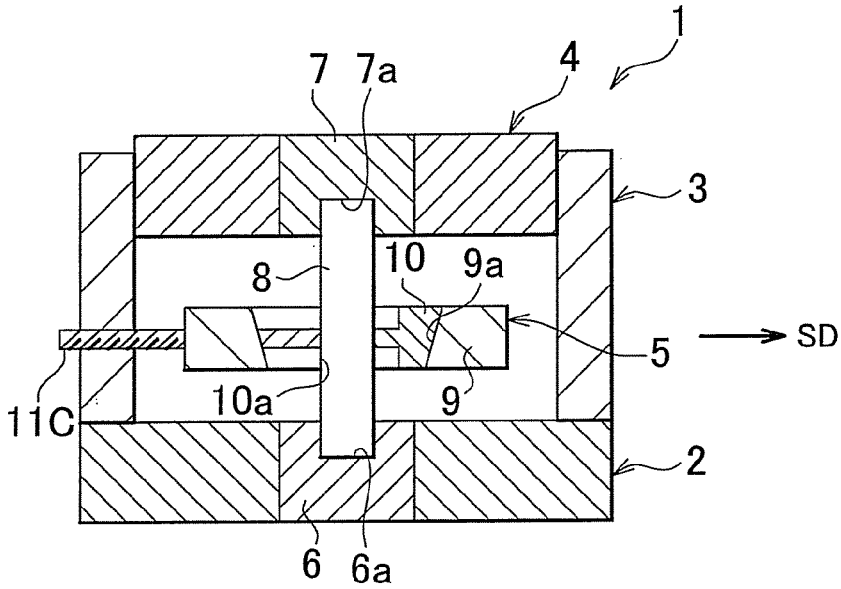
FIG. 11 relates to the first embodiment and shows a vertical sectional view of the production apparatus in the setting process.

(1) In the setting process, as shown in FIG. 10, the floating die 10 is set in the intermediate location of the shaft blank 8 and the annular member 9 is press fitted at the outer circumference of the die 10. The upper and lower end portions of the shaft blank 8 are inserted and installed in the receiving orifice 6*a* of the fixed die 6 and the receiving orifice 7*a* of the pushing die 7. As a result, as shown in FIG. 11, the shaft blank 8 that holds the floating jig 5 in the intermediate zone is supported vertically between the fixed jig 2 and the pushing jig 4. Upon completion of this setting process, the floating die 10 is held in the intermediate zone on the shaft blank 8, and the movement of the floating die 10 (floating jig 5) in any radial direction of the shaft blank 8 other than the specific direction SD is restricted.

Figure 12:
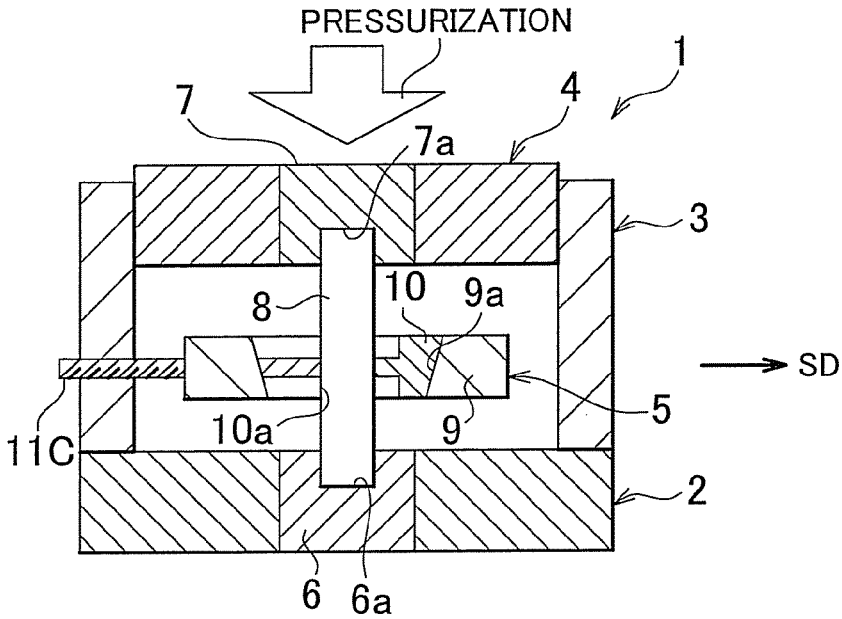
FIG. 12 is a vertical sectional view of the production apparatus in the pressurization process in the first embodiment.
Figure 13:
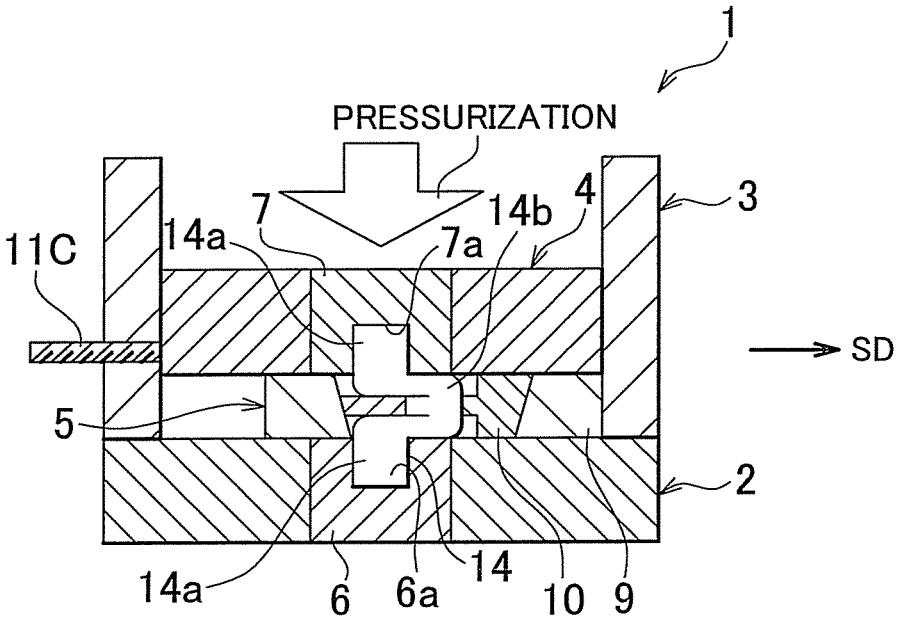
FIG. 13 is a vertical sectional view of the production apparatus in the pressurization process in the first embodiment.

(2) In the pressurization process, as shown in FIG. 12, the pushing jig 4 is pushed downward by a hydraulic device. As a result, an axial compressive load is applied to the shaft blank 8 and, as shown in FIG. 13, the shaft blank 8 is swaged, the floating die 10 (floating jig 5) is allowed to move in the specific direction SD, and the intermediate zone of the shaft blank 8 is buckled in the specific direction SD. At this time, as the pushing jig 4 is lowered, the bolts 11A to 11C are withdrawn in the outward direction of the guiding jig 3 to avoid interference with the pushing jig 4. As shown in FIG. 13, the floating jig 5 eventually moves from the initial state shown in FIGS. 11 and 12 in the specific direction SD (to the right in FIG. 13), and clamped between the fixed jig 2 and pushing jig 4. The shaft blank 8 is thus shaped to the predetermined shape between the fixed die 6, pushing die 7, and floating die 10.

Figure 14:
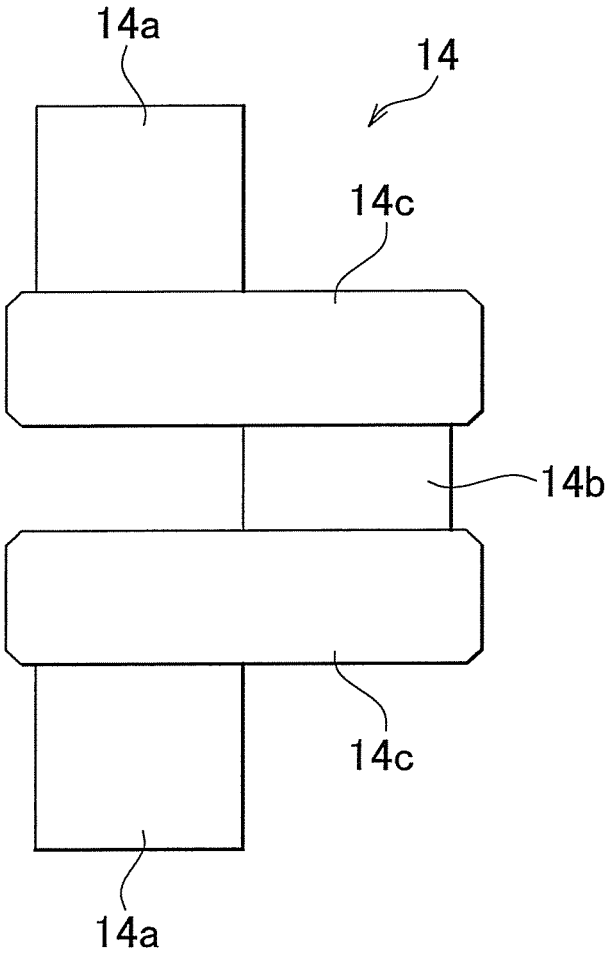
FIG. 14 is a plan view illustrating schematically the produced crankshaft in the first embodiment.

(3) In the mold release process, the pushing die 4 is raised, the shaped crankshaft is taken out from between the pushing die 4 and the fixed die 2, and the floating jig 5 is taken off from the shaped product. As a result, as shown schematically in FIG. 14, a crankshaft 14 is obtained that has a shaft portion 14*a*, a pin portion 14*b*, and an arm portion 14*c*. In the first embodiment, the comparatively long arm portion 14*c* is formed to increase the eccentricity amount of the pin portion 14*b* of the crankshaft 14 in order to increase the piston stroke.

Figures 15A, 15B, 15C, 15D:
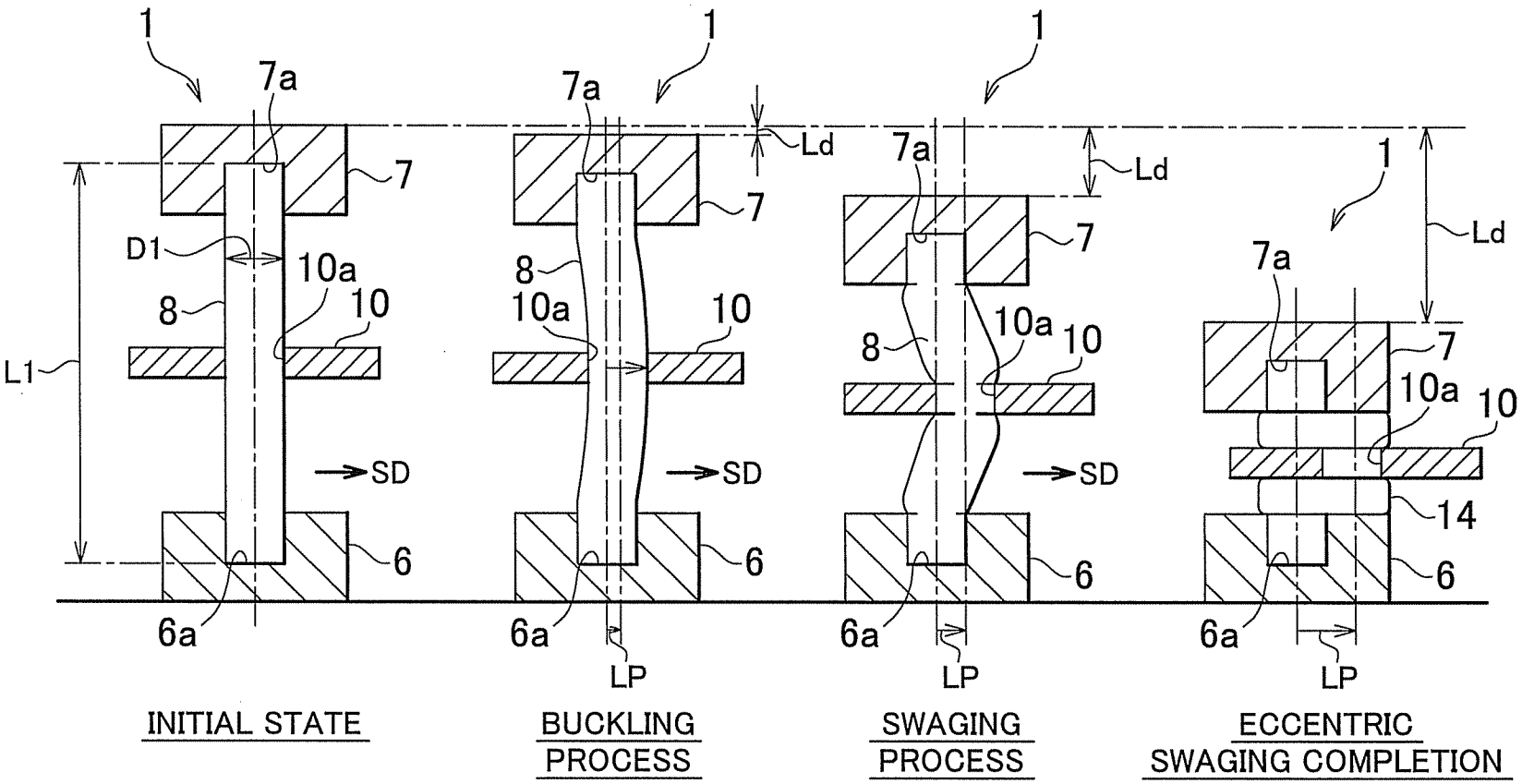

The series of the above-described production operations will be explained below in greater detail with reference to simplified cross-sectional views shown in FIGS. 15A to 15D. In the production method according to the first embodiment, in the "initial state" shown in FIG. 15A, the floating die 10 is mounted with the floating jig 5 on the intermediate zone of the shaft blank 8 in order to produce the crankshaft 14 from the shaft blank 8. Then, an axial compressive load is applied by the pushing die 7 to the shaft blank 8, while restricting the radial deformation in the intermediate zone of the shaft blank 8 in any direction other than the specific direction SD (to the right in the figure). As a result, in the "buckling process" shown in FIG. 15B, the intermediate zone of the shaft blank 8 is caused to start buckling in the specific direction SD. Then, in the "swaging process" shown in FIG. 15C, the shaft blank 8 is swaged and the intermediate zone of the shaft blank 8 is further buckled in the specific direction SD. In a state of "eccentric swaging completion" shown in FIG. 15D, the buckling and swaging of the shaft blank 8 are completed. Thus, it has been confirmed that in order to buckle the shaft blank 8 in the intermediate zone, a condition of "L1/D1>2.5" has to be fulfilled, where "L1" and "D1" stand for a length and diameter of the shaft blank 8, as shown in FIG. 15A. As shown in FIGS. 15A to 15D, it is clear that as the pushing die 7 is lowered, the shaft blank 8 buckles in the intermediate zone and the intermediate zone is eccentrically deformed. The descend amount Ld of the pushing die 7 corresponds to the compression amount of the shaft blank 8, and the eccentricity amount LP of the shaft blank 8 corresponds to the buckling amount of the shaft blank 8.

In other words, with the basic configuration of the production method according to the first embodiment, the shaft blank 8 is swaged and the intermediate zone thereof is buckled in the specific direction SD by applying pressure to both end portions of the shaft blank 8 with the pushing die 7 and fixed die 6 and applying the axial compressive load to the shaft blank 8, while restricting the radial deformation in the intermediate zone of the shaft blank 8 in any direction other than the specific direction SD.

An operation effect relating to the basic configuration of the above-described crankshaft production method and apparatus will be described below. Thus, in the production method, the movement of the floating die 10 held in the intermediate zone on the shaft blank 8 is restricted in any radial direction of the shaft blank 8 other than the specific direction SD in the setting process. In this restricted state, the shaft blank 8 is swaged, the movement of the floating die 10 in the specific direction SD is allowed, the shaft blank 8 is buckled and bent in the specific direction SD in the intermediate zone and shaped by the floating die 10, and the crankshaft 14 is produced by applying an axial compressive load to the shaft blank 8 in the pressurization process. Therefore, in order to produce the crankshaft 14 from the shaft blank 8, it is possible to omit an extra bending process. As a result, the production cycle time of the crankshaft 14 can be shortened by the duration of the omitted bending process.

Further, with the production apparatus 1, the floating die 10 is mounted on the shaft blank 8, and the floating die 10 is held by the annular member 9 in the intermediate zone on the shaft blank 8. Further, the movement of the floating die 10 and annular member 9 in the radial direction of the shaft blank 8, that is, the movement of the floating jig 5 in a direction other than the specific direction SD, is restricted by the three bolts 11A to 11C. The shaft blank 8 is swaged, the intermediate zone thereof is buckled and bent in the specific direction SD, the shaft blank 8 is shaped by the floating die 10, and the crankshaft 14 is produced by applying an axial compressive load to the shaft blank 8 by the pushing jig 4 in the restricted state. In other words, with the production apparatus 1, the crankshaft 14 can be produced without conducting a separate bending process for bending the intermediate zone of the shaft blank 8 in the specific direction SD. As a result, a punch or a hydraulic device for the bending process can be omitted and therefore the production apparatus 1 can be simplified and reduced in size.

In the first embodiment, the floating jig 5 is constituted by the floating die 10 that can be split into two pieces and the annular member 9 that is press fitted onto the outer circumference of the floating die 10. Further, in order to hold the fixed jig 5 on the shaft blank 8, the floating die 10, which can be split in two, is attached to cover the shaft blank 8 from above and the annular member 9 is pressed against the outer circumference of the floating die 10. Because of the relationship between the tapered hole 9*a* of the annular member and the outer circumferential tapered surface of the floating die 10, the annular member 9 can be easily mounted on the floating die 10. In order to take the fixed jig 5 off the shaft blank 8, the annular member 9 is removed from the floating die 10 and the floating die 10 is disassembled into two pieces. In this case, the annular member 9 also can be easily removed from the floating die 10 because of the relationship between the tapered hole 9*a* of the annular member and the outer circumferential tapered surface of the floating die 10. Therefore, the floating die 10 can be easily attached to the shaft blank 8 and detached therefrom. Furthered, because the buckling direction of the shaft blank 8 is restricted by providing only three bolts 11A to 11C in the guiding jig 3, the buckling direction can be restricted by a comparatively simple configuration.

Figure 16:
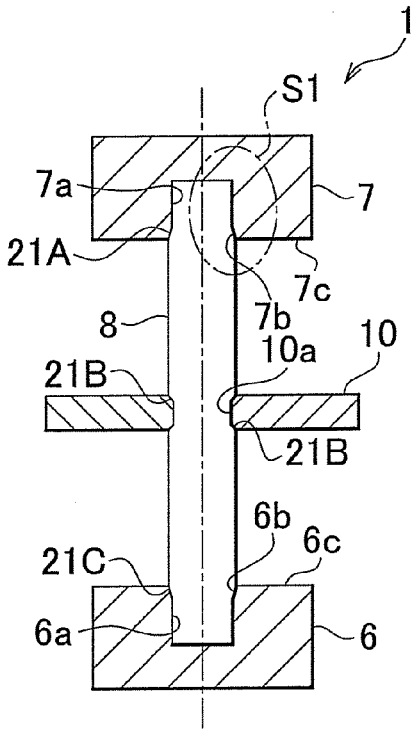
FIG. 16 is a cross-sectional view illustrating in a simple manner the production apparatus in the initial state in the first embodiment.
Figure 17:
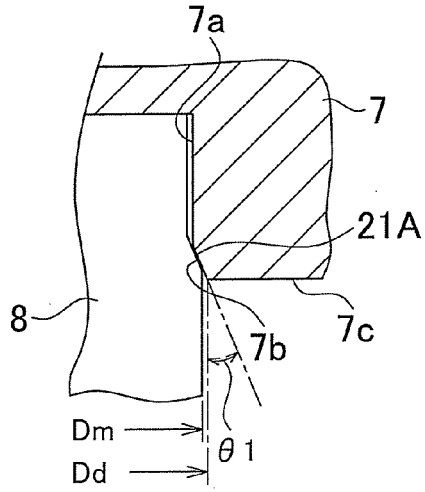
FIG. 17 is an enlarged cross-sectional view of a portion shown by a dash-line ellipse in FIG. 16 in the first embodiment.

Special portions of the configuration of the first embodiment will be explained below in greater detail. FIG. 16 is a simplified cross-sectional view of the production apparatus 1 in the initial state. FIG. 17 is an enlarged cross-sectional view of a portion shown by a dash-line ellipse S1 in FIG. 16. In the first embodiment, as shown in FIG. 16, steps 21A, 21B, 21C are formed in the upper portion, intermediate portion, and lower portion of the shaft blank 8. The inner surfaces of the receiving orifice 6*a* of the fixed die 6, receiving orifice 7*a* of the pushing die 7, and hole 10*a* of the floating die 10 are formed to have respective predetermined shapes matching those of the steps 21A to 21C of the shaft blank 8. The upper portion of the shaft blank 8 will be explained below by way of example. As shown in FIG. 17, the step 21A at the upper portion of the shaft blank 8 has a tapered shape. A portion of an opening edge 7*b* of the receiving orifice 7*a* of the pushing die 7 is provided with a tapered shape to match the shape of the step 21A. In this case, as shown in FIG. 17, where the taper angle of the tapered shape is denoted by "θ1", the maximum diameter of the portion of the step 21A of the shaft blank 8 is denoted by "Dm", and the maximum diameter in a position where the tapered surface of the opening edge 7*b* of the receiving orifice 7*a* crosses a bottom surface 7*c* of the pushing die 7, that is, the maximum diameter of the opening edge 7*b*, is denoted by "Dd", the relationship "Dd>Dm" is valid. The difference between "Dd" and "Dm" in this case can be, for example, 0.5 mm. Similar configurations are used with respect to the steps 21B, 21C of the lower portion and intermediate portion of the shaft blank 8, the receiving orifice 6*a* of the fixing die 6, and the hole 10*a* of the floating die 10.

Figure 18:
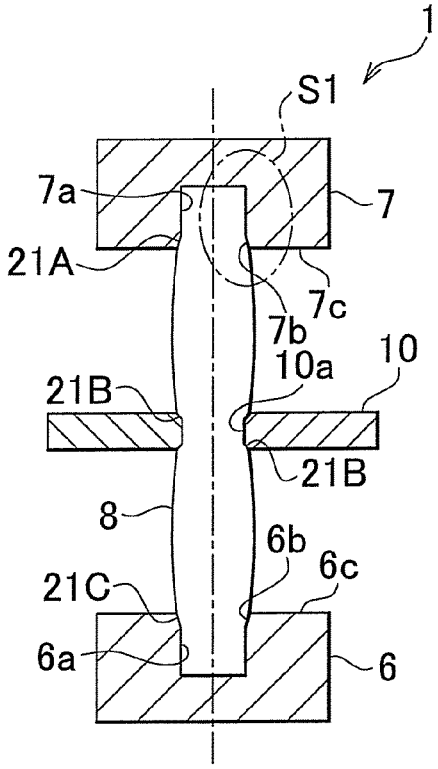
FIG. 18 is a simplified cross-sectional view of the production apparatus after the shaping has been started in the first embodiment.
Figure 19:
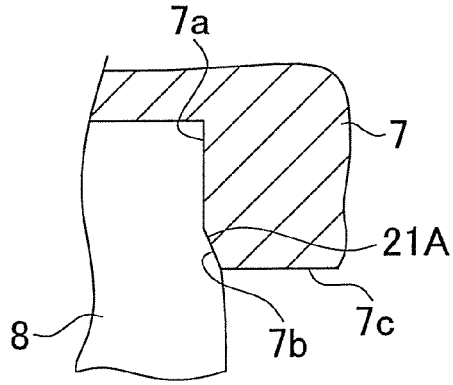
FIG. 19 is an enlarged cross-sectional view of a portion shown by a dash-line ellipse in FIG. 18 in the first embodiment.
Figure 20:
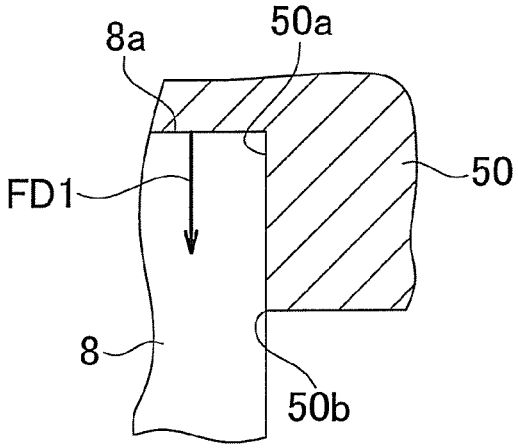
FIG. 20 is an enlarged cross-sectional view of a portion of the pushing die in a comparative example.
Figure 21:
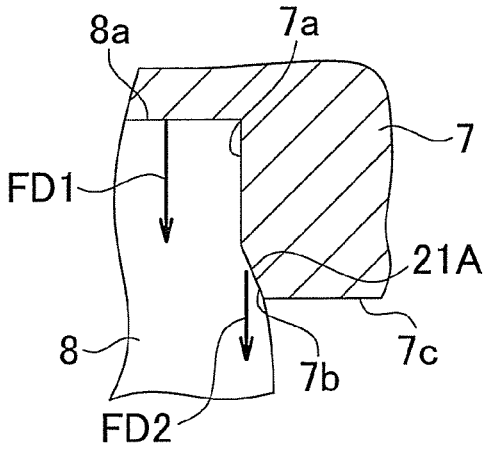
FIG. 21 is an enlarged cross-sectional view of a portion shown by a dash-line ellipse in FIG. 18 in the first embodiment.

Therefore, with the configuration of the special portions of the first embodiment, the upper portion, intermediate portion, and lower portion of the shaft blank 8 are in the form of tapered steps 21A to 21C, and portions such as the opening edge 7*b* of the receiving hole 7*a* of the pushing die 7, hole 10*a* of the floating die 10, and an opening edge of the receiving orifice 6*a* of the fixed die 6 are also tapered to match the shape of the tapered steps. As a result, intimate contact between the shaft blank 8 and the dies 7, 10, and 6 in the portions of steps 21A to 21C is improved. FIG. 18 is a simplified cross-sectional view of the production apparatus 1 after the shaping has been started. FIG. 19 is an enlarged cross-sectional view of the portion shown by a dash-line ellipse S1 in FIG. 18. As shown in FIGS. 18 and 19, in the steps 21A to 21C of the shaft blank 8, the tapered surfaces of the steps 21A to 21C are in intimate contact with the tapered surface of the opening edge 7*b*. Therefore, in the usual configuration in which no step is formed in the upper portion of the shaft blank 8 and an opening edge 50*b* of a receiving orifice 50*a* of a pushing die 50 has a simple angular shape, as shown by a cross-sectional view in FIG. 20 as a comparative example, a downward pushing force FD1 produced by the pushing die 50 is applied to an upper end surface 8*a* of the shaft blank 8. By contrast, in the first embodiment, for example, as shown by a cross-sectional view in FIG. 21, a downward pushing force FD2 is applied to a portion of the step 21A in addition to the upper end surface 8*a* of the shaft blank 8. As a result, a compressive force acting upon the shaft blank 8 in the production apparatus 1 at the initial state of shaping can be increased and cracking of the shaft blank 8 or a shaped product thereof can be inhibited.

Figures 22A, 22B:
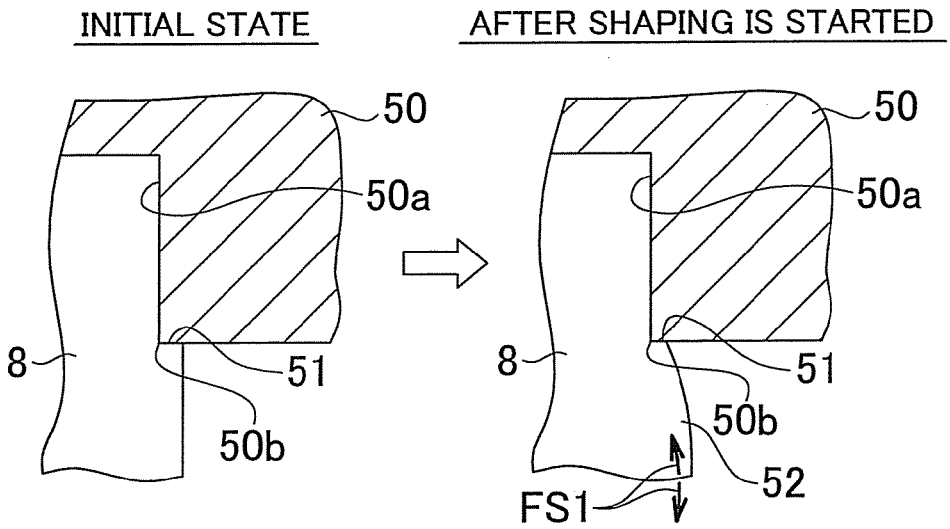
FIGS. 22A and 22B are enlarged cross-sectional views of a portion of the pushing die according to the comparative example.
Figure 23:
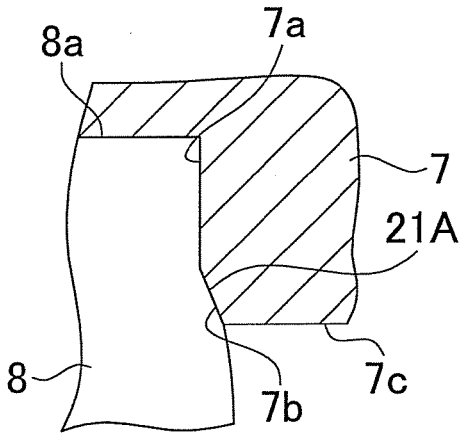
FIG. 23 is an enlarged cross-sectional view of a portion of the pushing die after the shaping has been started in the first embodiment.

Further, with the special portions according to the first embodiment, the steps 21A to 21C of the shaft blank 8 and the opening edges 7*b* of the receiving orifices 7*a*, 6*a* and hole 10*a* of the dies 7, 10, and 6 are provided with tapered shapes. As a result, the shaft blank 8 is not excessively swaged into a barrel-like shape in portions such as the opening edges 7*b* of the dies 7, 10, and 6. Thus, let us consider a configuration in which the upper portion of the shaft blank 8 is a simple step 51 rather than a tapered portion, and the opening edge 50*b* of the receiving orifice 50*a* of the pushing die 50 has a simple angular shape as shown by an enlarged cross-sectional view of part of the pushing die 50 as a comparative example in FIGS. 22A and 22B. In this case, a barrel-like bulge 52 appears in the shaft blank 8 at the boundary of the pushing die 50 within the interval from the initial state to after the start of shaping, and a tensile stress FS1 at the surface of the shaft blank 8 increases. By contrast, in the first embodiment, for example, as shown by a cross-sectional view in FIG. 23, no excessive swaging of the shaft blank 8 into a barrel-like shape occurs at the boundary with the pushing die 7 and the tensile stresses at the surface of the shaft blank 8 that are created by swaging can be relaxed.

Figure 24:
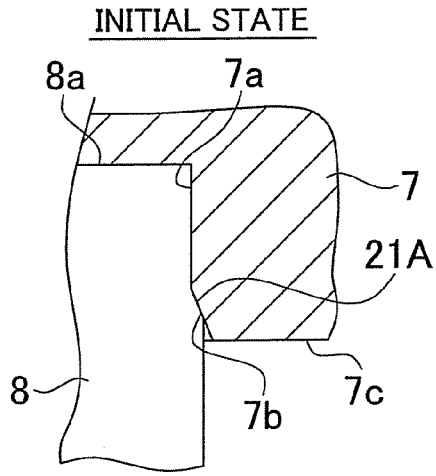
FIG. 24 is an enlarged cross-sectional view of a portion of the pushing die in the initial state in the first embodiment.
Figure 25:
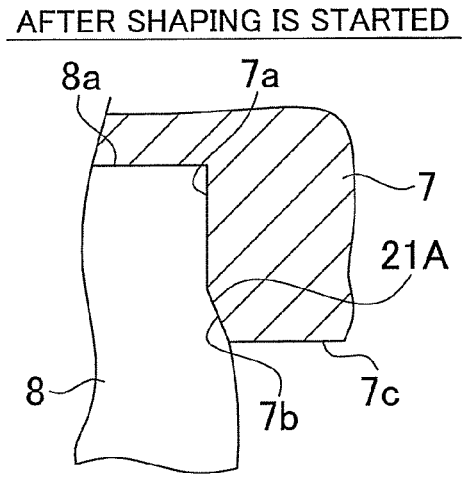
FIG. 25 is an enlarged cross-sectional view of a portion of the pushing die after the shaping has been started in the first embodiment.

Further, with the special portions according to the first embodiment, the maximum diameter Dd of the opening edge 7*b* of the receiving orifice 7*a* of the pushing die 7 is set larger than the maximum diameter Dm of the step 21A of the shaft blank 8. Therefore, as shown by an enlarged cross-sectional view of part of the pushing die 7 in FIGS. 24 and 25, a swaging process can be advanced till the step 21A of the shaft blank 8 has a size of the maximum diameter Dd of the opening edge 7*b* from the initial state to after the start of shaping, and a sufficient compressive force can be applied to the shaft blank 8.

Second Embodiment

The second specific embodiment of the crankshaft production method and production apparatus in accordance with the invention will be explained below in greater details with reference to the appended drawings.

In the explanation below, structural elements similar to those of the first embodiment will be assigned with like reference numerals and explanation thereof will be omitted. The explanation will be focused on the different aspects.

With the configuration of special portions according to the first embodiment, a vertical load can be effectively applied to the shaft blank 8. However, the steps 21A to 21C have to be formed in advance in the shaft blank 8 and the number of machining, operations is accordingly increased. The second embodiment is so configured that a vertical load can be effectively applied to the shaft blank 8, without the necessity of conducting a preliminary machining required to form the steps at the shaft blank 8. Thus, the second embodiment is different from the first embodiment in the configuration of the pushing die 7 and fixed die 6.

Figure 26:
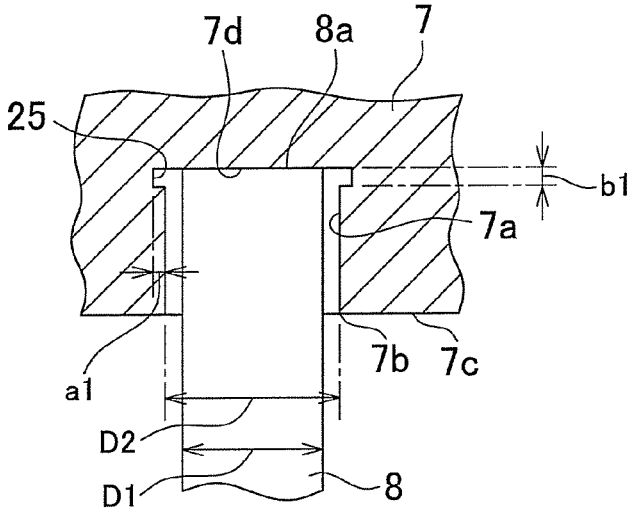
FIG. 26 is a cross-sectional view that partially illustrates the relationship between the receiving orifice of the pushing die and the shaft blank in the initial state in the second embodiment.
Figure 27:
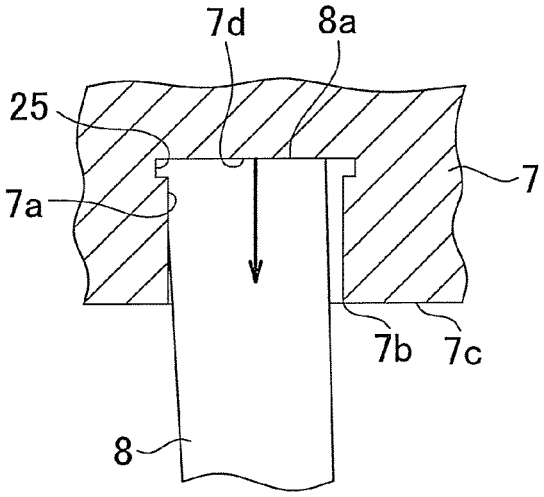
FIG. 27 is a cross-sectional view that partially illustrates the relationship between the receiving orifice of the pushing die and the shaft blank after the shaping has been started in the second embodiment.

FIG. 26 shows a cross-sectional view illustrating partially the relationship between the receiving orifice 7*a* of the pushing die 7 and the shaft blank 8 in the initial state in the second embodiment. FIG. 27 shows a cross-sectional view illustrating partially the relationship between the receiving orifice 7*a* of the pushing die 7 and the shaft blank 8 after the shaping has been started in the second embodiment. As shown in FIG. 26, in the pushing die 7 of the second embodiment, the inner diameter D2 of the receiving orifice 7*a* is increased over the diameter D1 of the shaft blank 8 by a predetermined value a1 (for example, about 0.05 to 0.1 mm) at one side and by a predetermined value b1 (for example, about 2.0 mm) in the axial direction, thereby forming a peripheral groove 25 at the outer circumference of the bottom portion 7*d* of the receiving orifice 7*a*. The fixed die 6 has a similar configuration.

Further, in the production method according to the second embodiment, when both end portions of the shaft blank 8 are inserted into the receiving orifice 7*a* of the pushing die 7 and the receiving orifice 6*a* of the fixed die 6 and both end portions of the shaft blank 8 are pressurized by the two dies 7 and 6, the end portions of the shaft blank 8 are caused to expand into the circumferential groove 25.

Therefore, with the configuration of the special portions of the second embodiment, when the end portions of the shaft blank 8 are inserted into the receiving orifices 7*a*, 6*a* of the two dies 7, 6 and both end portions of the shaft blank 8 are pressurized by the two dies 7, 6, as shown in FIG. 27, part of the material of the end portions of the shaft blank 8 enters the circumferential groove 25 of the receiving orifice 7*a* of the pushing die 7 after the shaping has been started and the end portions of the shaft blank 8 are caused to expand radially by the size of the circumferential groove 25. As a result, the bottom portion 7*d* of the receiving orifice 7*a* and the end surface 8*a* of the shaft blank 8 are brought into reliable contact with each other and a compressive load acting upon the shaft blank 8 at the initial stage of shaping is increased. A similar operation is realized with respect to the fixed die 6. Therefore, a vertical load can be reliably applied to the shaft blank 8 at the initial state of shaping of the crankshaft 14 and cracking of the shaft blank 8 at the initial stage of shaping can be inhibited.

A knock-out pin is provided in the pushing die 7 correspondingly to the receiving orifice 7*a* (the pin is not shown in FIGS. 26 and 27). Therefore, the end portion of the shaft blank 8 can be easily pushed out of the receiving orifice 7*a* by operating the knock-out pin after the shaping has been completed.

Third Embodiment

The third specific embodiment of the crankshaft production method and production apparatus in accordance with the invention will be explained below in greater details with reference to the appended drawings.

Figure 28:
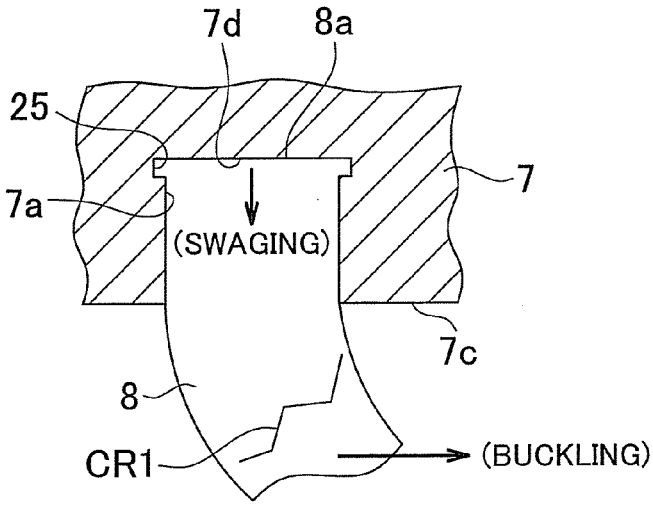
FIG. 28 is a cross-sectional view that partially illustrates the relationship between the receiving orifice of the pushing die and the shaft blank in the buckling process in the second embodiment.

With the configuration of special portions according to the second embodiment, although a vertical load can be reliably applied to the shaft blank 8 during shaping, the following problems can occur in the buckling process. FIG. 28 relates to the second embodiment and shows a cross-sectional view that partially illustrates the relationship between the receiving orifice 7*a* of the pushing die 7 and the shaft blank 8 in the buckling process. Thus, where the shaft blank 8 is reliably pressurized by the bottom portion 7*d* of the receiving orifice 7*a* in the vertical direction, "buckling (eccentric deformation)" can proceed in advance of "swaging". As a result, a shear crack CR1 can appear in the bending portion of the shaft blank 8. Accordingly, in the third embodiment, the shape of the bottom portion 7*d* (pressurization surface 15) of the receiving orifice 7*a* is improved.

Figure 29:
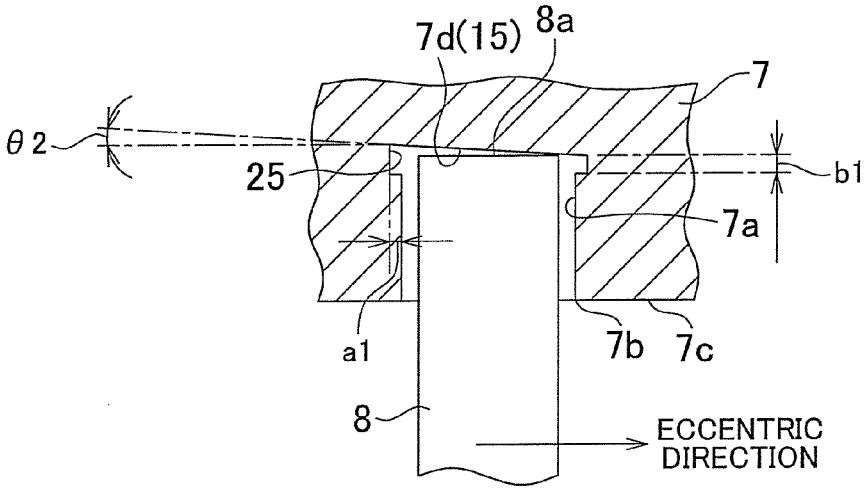
FIG. 29 is a cross-sectional view that partially illustrates the relationship between the receiving orifice of the pushing die and the shaft blank in the initial state in the third embodiment.
Figure 30:
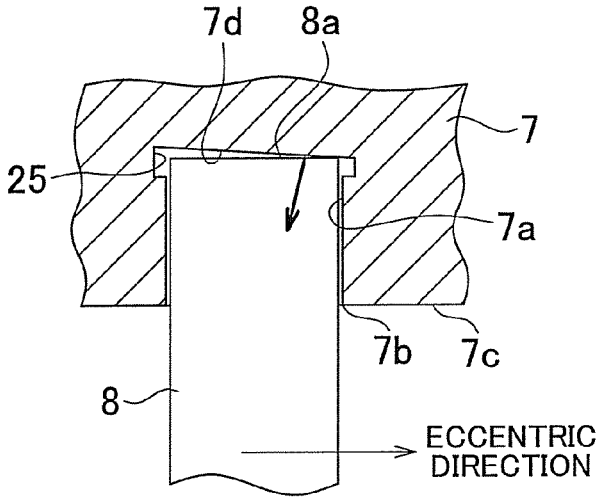
FIG. 30 is a cross-sectional view that partially illustrates the relationship between the receiving orifice of the pushing die and the shaft blank after the shaping has been started in the third embodiment.

FIG. 29 relates to the third embodiment and shows a cross-sectional view that partially illustrates the relationship between the receiving orifice 7*a* of the pushing die 7 and the shaft blank 8 in the initial state. FIG. 30 shows a cross-sectional view that partially illustrates the relationship between the receiving orifice 7*a* of the pushing die 7 and the shaft blank 8 after the shaping has been started. As shown in FIG. 29, in addition to the features of the second embodiment, the bottom portion 7*d* of the receiving orifice 7*a* in the pushing die 7 of the third embodiment is provided with a predetermined inclination angle θ2 such as to be inclined toward the eccentric deformation direction (buckling direction) of the shaft blank 8. Thus, in the third embodiment, the pressurization surface 15 of the pushing die 7 that applies pressure to the end surface 8*a* of the shaft blank 8 is inclined so as to become lower toward a specific direction SD and toward the other end side of the shaft blank 8. A range of about 3 to 10° can be considered for the inclination angle θ2. The inclination angle θ2 can be appropriately changed according to the eccentricity amount or shape of the shaft blank 8. The fixed die 6 has a similar configuration.

With the production method according to the third embodiment, when both ends of the shaft blank 8 are pressurized by the pushing die 7 and the fixed die 6, the end surface 8*a* of the shaft blank 8 is pressurized by the inclined pressurization surface 15, thereby applying a compressive load to the shaft blank 8 such that prevents buckling from being ahead of swaging.

Therefore, with the configuration of the special portions according to the third embodiment, an operation effect similar to that of the second embodiment can be obtained. In addition, in the third embodiment, the bottom portion 7*d* of the receiving orifice 7*a* is inclined in the eccentric deformation direction. As a result, a compressive force acts upon the shaft blank 8 in the direction of suppressing the eccentric direction. Thus, the end surface 8*a* of the shaft blank 8 is pressurized by the inclined pressurization surface 15 of the dies 7, 6, whereby a compressive load is applied to the shaft blank 8 such that prevents buckling from being ahead of swaging. As a result, an excessive advance of buckling is suppressed and the occurrence of excessive tensile stresses in the shaft blank 8 is inhibited. Therefore, the occurrence of shear cracking CR1 in the bent portion of the shaft blank 8 under the effect of buckling in the course of eccentric swaging-forging can be inhibited.

Fourth Embodiment

The fourth specific embodiment of the crankshaft production method and production apparatus in accordance with the invention will be explained below in greater details with reference to the appended drawings.

Figure 31:
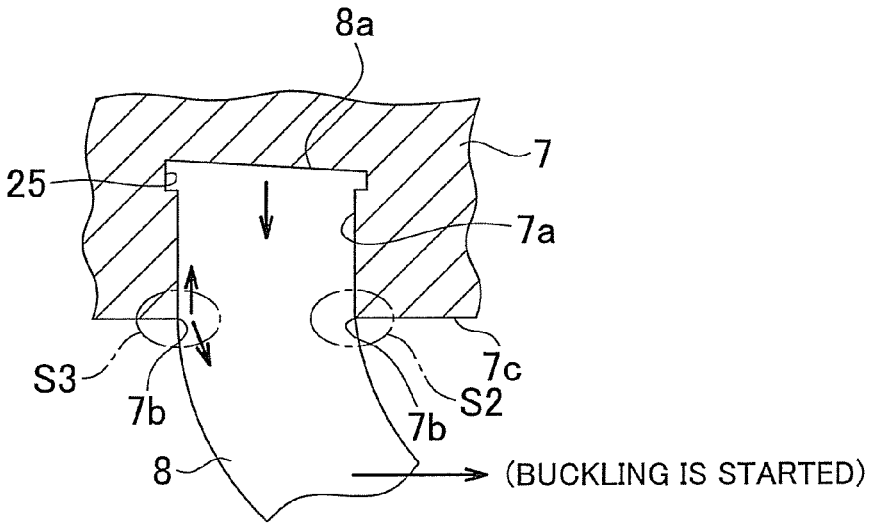
FIG. 31 is a cross-sectional view that partially illustrates the relationship between the receiving orifice of the pushing die and the shaft blank in the buckling process in the third embodiment.

With the configuration of special portions according to the third embodiment, although the shear cracking CR1 of the shaft blank 8 in the buckling process can be inhibited, the following problems can be encountered. FIG. 31 relates to the third embodiment and shows a cross-sectional view that partially illustrates the relationship between the receiving orifice 7*a* of the pushing die 7 and the shaft blank 8 in the buckling process. Thus, where the shaft blank 8 starts buckling, the floating die 10 moves eccentrically, a compressive force acts upon a buckling direction side (portion shown by a dash-line ellipse S2) of the opening edge 7*b* of the receiving orifice 7*a*, a large tension force acts on the side of the opening edge 7*b* that is opposite the budding direction side (portion shown by a dash-line ellipse S3), and a crack can occur in the shaft blank 8. Accordingly, in the fourth embodiment, the shape of the opening edge 7*b* of the receiving orifice 7*a* is improved.

Figure 32:
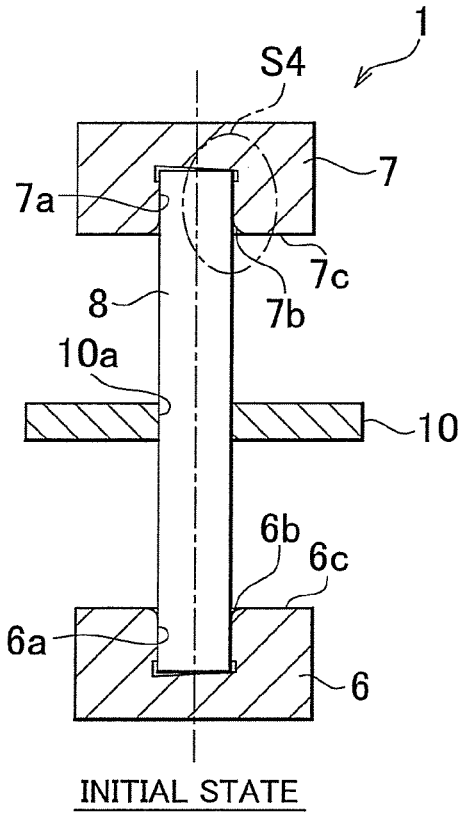
FIG. 32 is a simplified cross-sectional view of the production apparatus in the initial state in the fourth embodiment.
Figure 33:
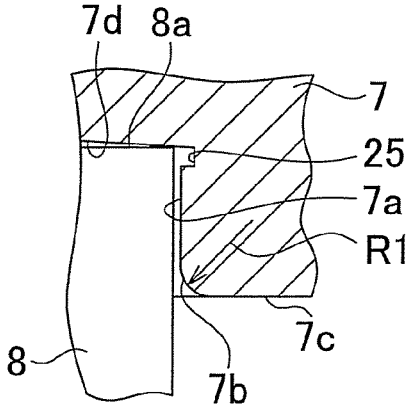
FIG. 33 is an enlarged cross-sectional view of a portion of the production apparatus shown in FIG. 32 that is surrounded by a dash-line ellipse in the fourth embodiment.

FIG. 32 relates to the fourth embodiment and shows a simplified cross-sectional view of the production apparatus 1 in the initial state. FIG. 33 shows an enlarged cross-sectional view of a portion surrounded by a dash-line ellipse S4 in FIG. 32. As shown in FIGS. 32 and 33, in the pushing die 7 according to the fourth embodiment, in addition to the features of the third embodiment, the opening edge 7*b* of the receiving orifice 7*a* is formed in a circular arc shape. Where the radius of the circular arc shape is denoted by "R" and the diameter of the shaft blank 8 is denoted by "D", the relationship represented by formula (1) below can be taken as a setting condition. The fixed die 6 has a similar configuration.

$$R>D*0.04 \quad (1)$$

With the production method according to the fourth embodiment, when the end portions of the shaft blank 8 are inserted into the receiving orifices 7*a*, 6*a* of the dies 7, 6 and both end portions of the shaft blank 8 are pressurized by the dies 7, 6, the shaft blank 8 is deformed according to the circular-arc opening edges 7*b*, 6*b*.

Figure 34:
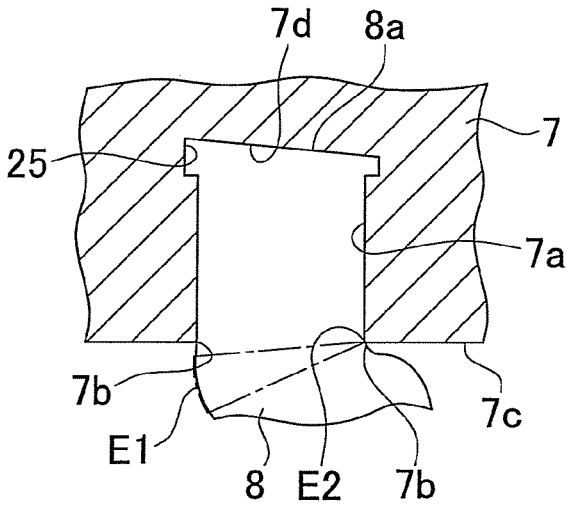
FIG. 34 is a cross-sectional view that partially illustrates the relationship between the receiving orifice of the pushing die and the shaft blank in the buckling process in a comparative example.
Figure 35:
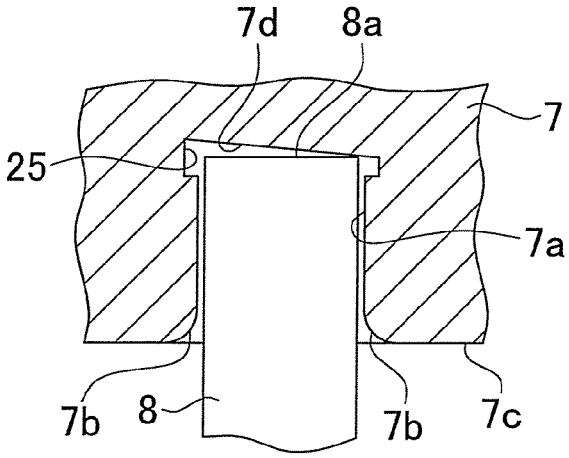
FIG. 35 is a cross-sectional view that partially illustrates the relationship between the receiving orifice of the pushing die and the shaft blank in the initial state in the fourth embodiment.
Figure 36:
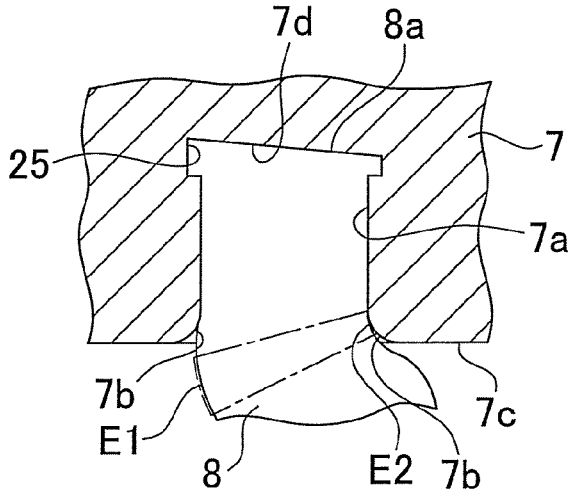
FIG. 36 is a cross-sectional view that partially illustrates the relationship between the receiving orifice of the pushing die and the shaft blank in the buckling process in the fourth embodiment.

Therefore, with the configuration of the special portions according to the fourth embodiment, when both end portions of the shaft blank 8 are pressurized by the dies 7, 6, the opening edges 7*b*, 6*b* of the receiving orifices 7, 6 are formed in a circular arc shape. Therefore, after the buckling has been started, the bent portion (inner side of the buckled portion) of the shaft blank 8 is deformed according to the circular arc of the opening edge 7*b*. As a result, the occurrence of an excessively large tensile stress on the outer side of the buckled portion of the shaft blank 8 is inhibited. Therefore, as partially shown by a cross-sectional view in FIG. 34, in the configuration in which the opening edge 7*b* of the receiving orifice 7*a* does not have a circular arc shape, such as the configuration of the third embodiment, the stress tends to increase by the difference between a strain E1 on the side of the opening edge 7*b* that is opposite the buckling direction and a strain E2 on the buckling direction side. By contrast, in the fourth embodiment, where a transition is made from the initial state shown in a cross-sectional view in FIG. 35 to a buckling process shown in a cross-sectional view in FIG. 36, the strain E2 of the buckling direction side of the opening edge 7*b* increases over that shown in FIG. 34. As a result, the difference between a strain E1 on the side of the opening edge 7*b* that is opposite the buckling direction and a strain E2 on the buckling direction side decreases and the stress decreases correspondingly to the decrease in the difference between the strain E1 and the strain E2. As a result, in the buckling process, the stress acting upon the outer side of the buckled portion of the shaft blank 8 can be reduced and the cracking in this portion can be inhibited.

Fifth Embodiment

The fifth specific embodiment of the crankshaft production method and production apparatus in accordance with the invention will be explained below in greater details with reference to the appended drawings.

Figure 37:
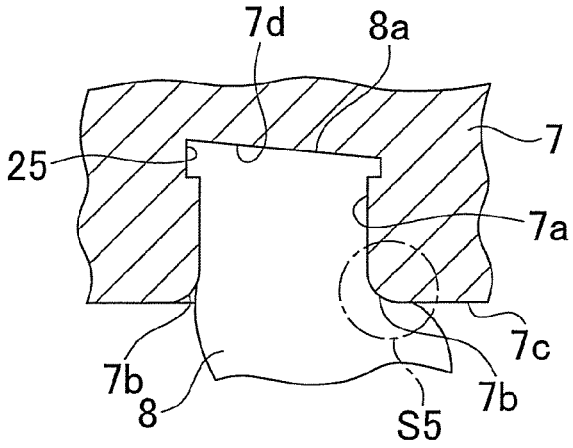
FIG. 37 is a cross-sectional view that partially illustrates the relationship between the receiving orifice of the pushing die and the shaft blank in the swaging process in the fourth embodiment.
Figure 38:
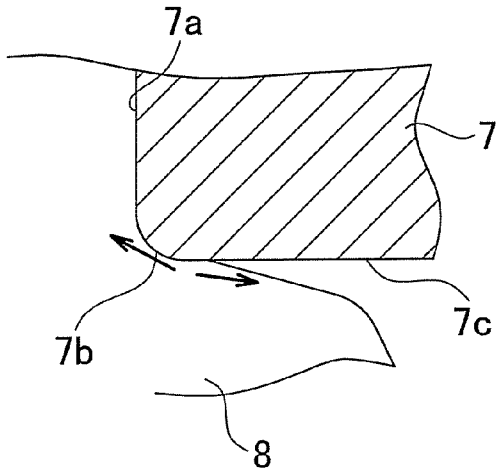
FIG. 38 is an enlarged cross-sectional view of a portion shown by a dash-line circle in FIG. 37 in the fourth embodiment.

With the configuration of special portions according to the fourth embodiment, although the cracking at the outer side of the buckled portion of the shaft blank 8 can be inhibited, the following problems can be encountered. FIG. 37 relates to the fourth embodiment and shows a cross-sectional view that partially illustrates the relationship between the receiving orifice 7*a* of the pushing die 7 and the shaft blank 8 in the swaging process. FIG. 38 shows an enlarged cross-sectional view of a portion shown by a dash-line circle S5 in FIG. 37. Thus, as shown in FIGS. 37 and 38, in the swaging process, a slip can occur in the opening edge 7*b* of the receiving orifice 7*a* and in a contact portion of the bottom surface 7*c* and shaft blank 8 that follows the opening edge. Because of this slip, local tension can act upon the shaft blank 8 and a crack can occur. Accordingly, in the fifth embodiment, mainly the form of the bottom surface 7*c* of the pushing die 7 is improved.

Figure 39:
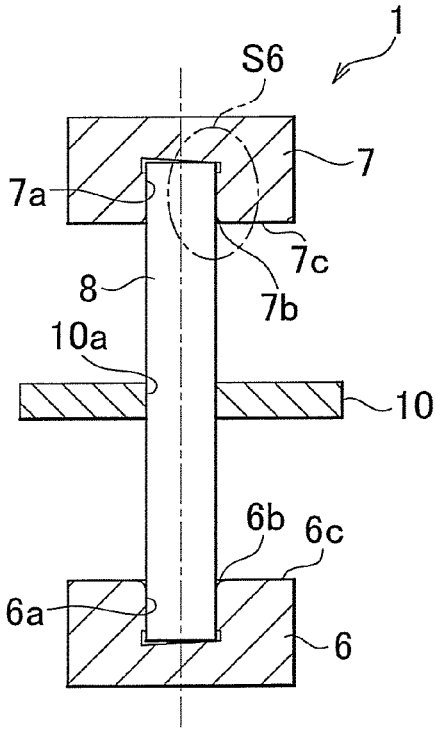
FIG. 39 is a simplified cross-sectional view of the production apparatus in the initial state in the fifth embodiment.
Figure 40:
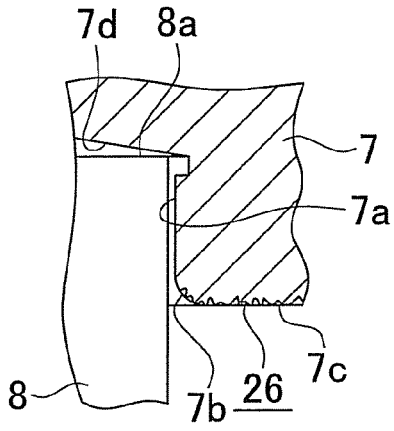
FIG. 40 is an enlarged cross-sectional view of a portion shown by a dash-line ellipse in FIG. 39 in the fifth embodiment.
Figure 41:
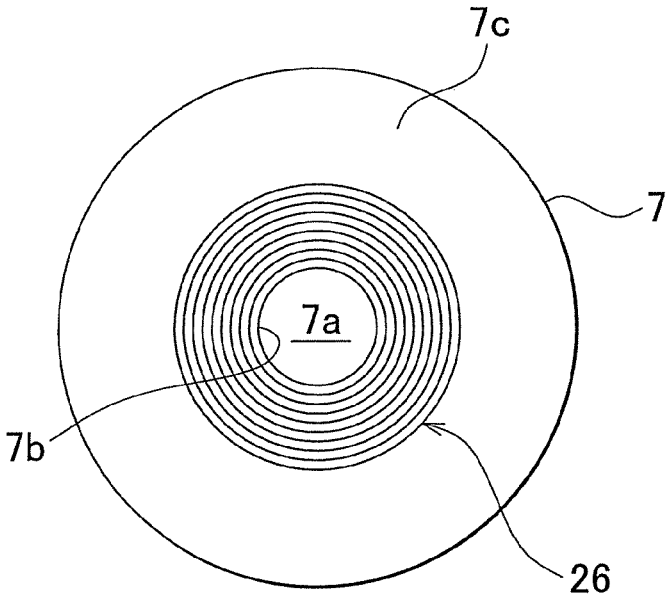
FIG. 41 is a bottom surface view of the pushing die illustrating a variation of the portion with increased surface roughness in the fifth embodiment.
Figure 42:
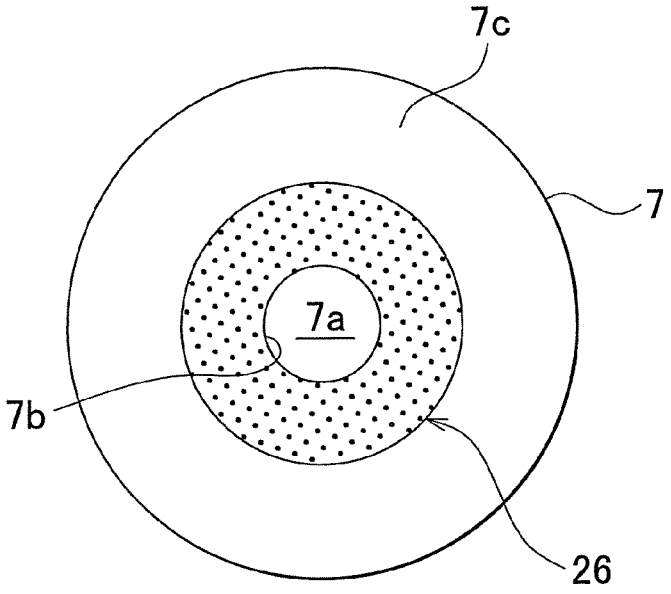
FIG. 42 is a bottom surface view of the pushing die illustrating a variation of the portion with increased surface roughness in the fifth embodiment.
Figure 43:
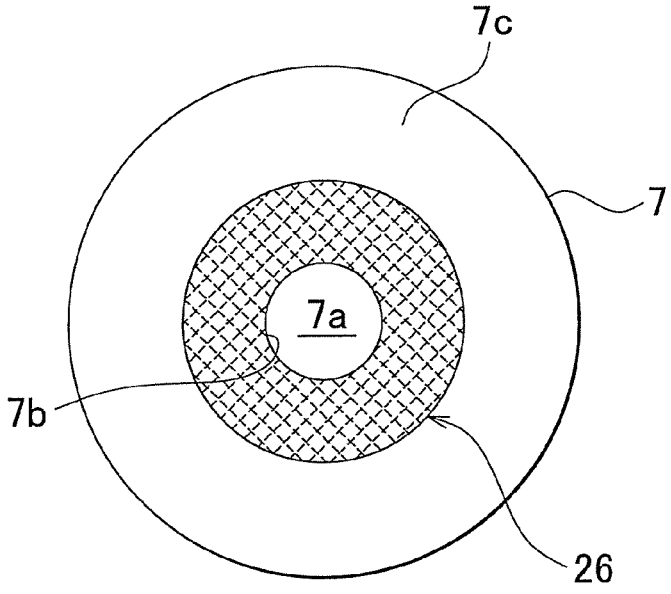
FIG. 43 is a bottom surface view of the pushing die illustrating a variation of the portion with increased surface roughness in the fifth embodiment.

FIG. 39 relates to the fifth embodiment and shows a simplified cross-sectional view of the production apparatus 1 in the initial state. FIG. 40 shows an enlarged cross-sectional view of a portion shown by a dash-line ellipse S6 in FIG. 39. As shown in FIGS. 39 and 40, in the pushing die 7 according to the fifth embodiment, in addition to the features of the fourth embodiment, a surface roughness is increased in a predetermined portion of the opening edge 7*b* of the receiving orifice 7*a* and the bottom surface 7*c* that follows the opening edge. This portion will be referred to herein as "a portion 26 with increased surface roughness". FIGS. 41 to 43 are bottom surface views showing the variations of the configuration of the portion 26 with increased surface roughness. For example, in the fifth embodiment, as shown in FIG. 41, the portion 26 with increased surface roughness is formed at the bottom surface 7*c* of the pushing die 7 by forming concentric concavities and convexities with a lathe around the receiving orifice 7*a*. As shown in FIG. 42, the portion 26 with increased surface roughness can be also formed by providing a ceramic coating. Further, as shown in FIG. 43, the portion 26 with increased surface roughness can be also formed by roughening the surface with a laser or the like. The fixed die 6 has a similar configuration.

Further, in the production method according to the fifth embodiment, when the surface of the shaft blank 8 that will be buckled is pressurized by the bottom surfaces 7*c*, 6*c* of the two dies 7, 6, because the pressurization is conducted by the portion 26 with increased surface roughness, a compressive load is applied to the shaft blank 8 such that the slip between the surface of the shaft blank 8 that will be budded and the bottom surfaces 7*c*, 6*c* of the dies 7, 6 will be inhibited.

Therefore, with the configuration of the special portions according to the fifth embodiment, the predetermined portion of the opening edge 7*b* of the receiving orifice 7*a* of the pushing die 7 and the bottom surface 7*c* that follows the opening edge is formed as the portion 26 with increased surface roughness. As a result, the slip in the contact portion of the surface of the shaft blank 8 and the opening edge 7*b* of the receiving orifice 7*a* and the bottom surface 7*c* that follows the opening edge is inhibited. Thus, when the surface of the shaft blank 8 that will be buckled is pressurized by the bottom surfaces 7*c*, 6*c* of the two dies 7, 6, because the pressurization is conducted by the portion 26 with increased surface roughness, a compressive load is applied to the shaft blank 8. As a result, the slip between the surface of the shaft blank 8 that will be buckled and the bottom surfaces 7*c*, 6*c* of the dies 7, 6 is inhibited. The occurrence of local tensile stresses and shear stresses at the surface of the shaft blank 8 is thereby inhibited. Therefore, local cracking of the surface of the shaft blank 8 in the swaging process can be inhibited.

Sixth Embodiment

The sixth specific embodiment of the crankshaft production method and production apparatus in accordance with the invention will be explained below in greater details with reference to the appended drawings.

Figure 44:
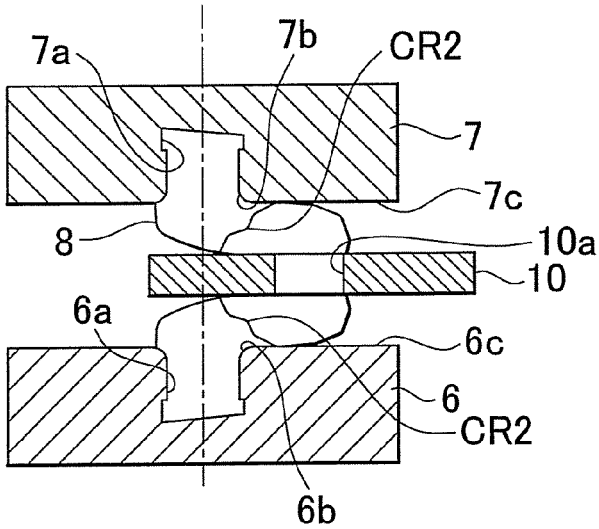
FIG. 44 is a cross-sectional view illustrating in a simple manner the production apparatus in the latter half of the swaging process in the fifth embodiment.

FIG. 44 is a cross-sectional view illustrating in a simple manner the production apparatus 1 in the latter half of the swaging process in the fifth embodiment. With the configuration of the special portions according to the fifth embodiment, local cracking of the surface of the shaft blank 8 in the swaging process can be inhibited. However, in the latter half of the swaging process, tensile stresses or shear stresses in the shaft blank 8 can increase and shaping cracks CR2 can appear therein. Accordingly, in the sixth embodiment, the form of the bottom surfaces 7*c*, 6*c* of the pushing die 7 and the fixed die 6 are further improved.

Figure 45:
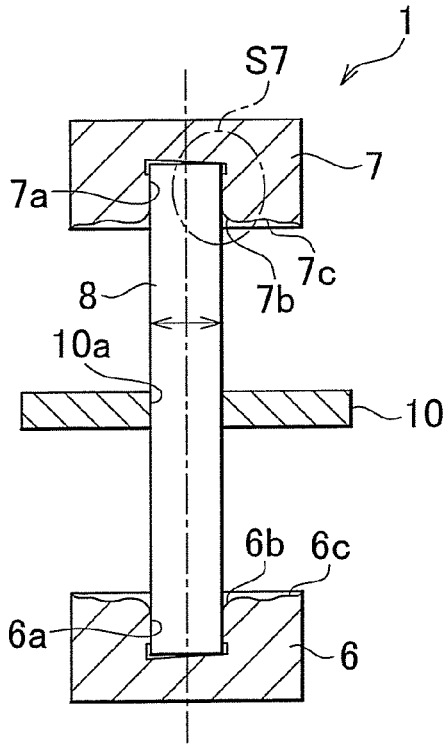
FIG. 45 is a cross-sectional view illustrating in a simple manner the production apparatus in the initial state in the sixth embodiment.
Figure 46:
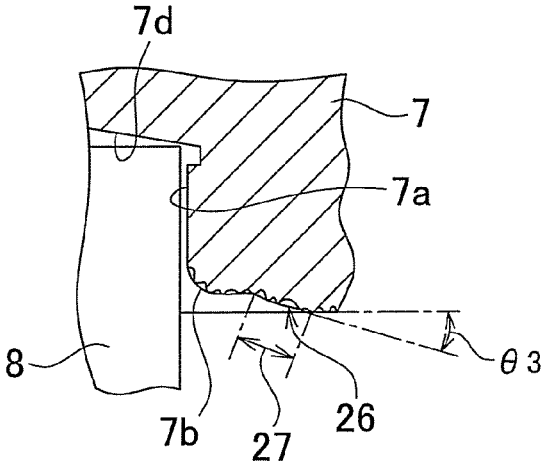
FIG. 46 is an enlarged cross-sectional view of a portion shown by a dash-line ellipse in FIG. 45 in the sixth embodiment.
Figure 47:
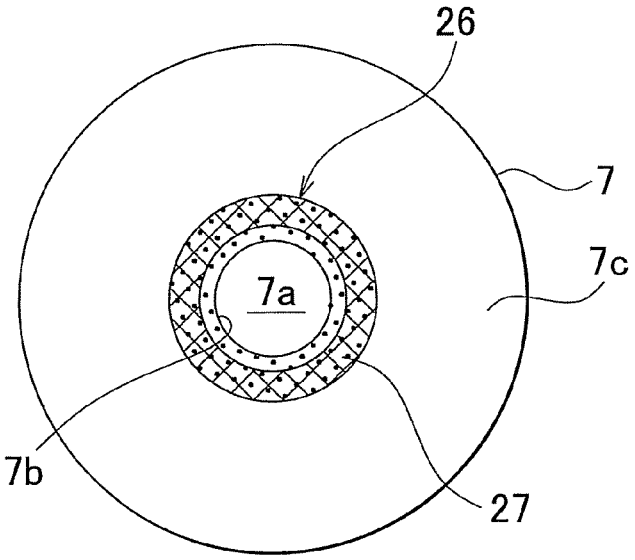
FIG. 47 is a bottom view showing a pushing die in the sixth embodiment.

FIG. 45 is a cross-sectional view illustrating in a simple manner the production apparatus 1 in the initial state in the sixth embodiment. FIG. 46 is an enlarged cross-sectional view of a portion shown by a dash-line ellipse S7 in FIG. 45. FIG. 47 is a bottom view showing the pushing die 7 in the sixth embodiment. As shown in FIGS. 45 to 47, in the pushing die 7 according to the sixth embodiment, in addition to the features of the fifth embodiment, that is, in addition to providing the portion 26 with increased surface roughness (in the sixth embodiment, a ceramic coating is formed) at the opening edge 7*b* of the receiving orifice 7*a* and the bottom surface 7*c* that follows the opening edge, an inclined portion 27 (meshed portion in FIG. 47) that is inclined at a predetermined inclination angle θ3 is provided at part of the portion with the increased surface roughness concentrically around the receiving orifice 7*a*. The predetermined inclination angle θ3 can be taken, for example, as 5 to 30°. The inclined portion 27 is so inclined as to descend in the specific direction SD and toward the other end side of the shaft blank 8. The fixed die 6 has a similar configuration.

Figure 48:
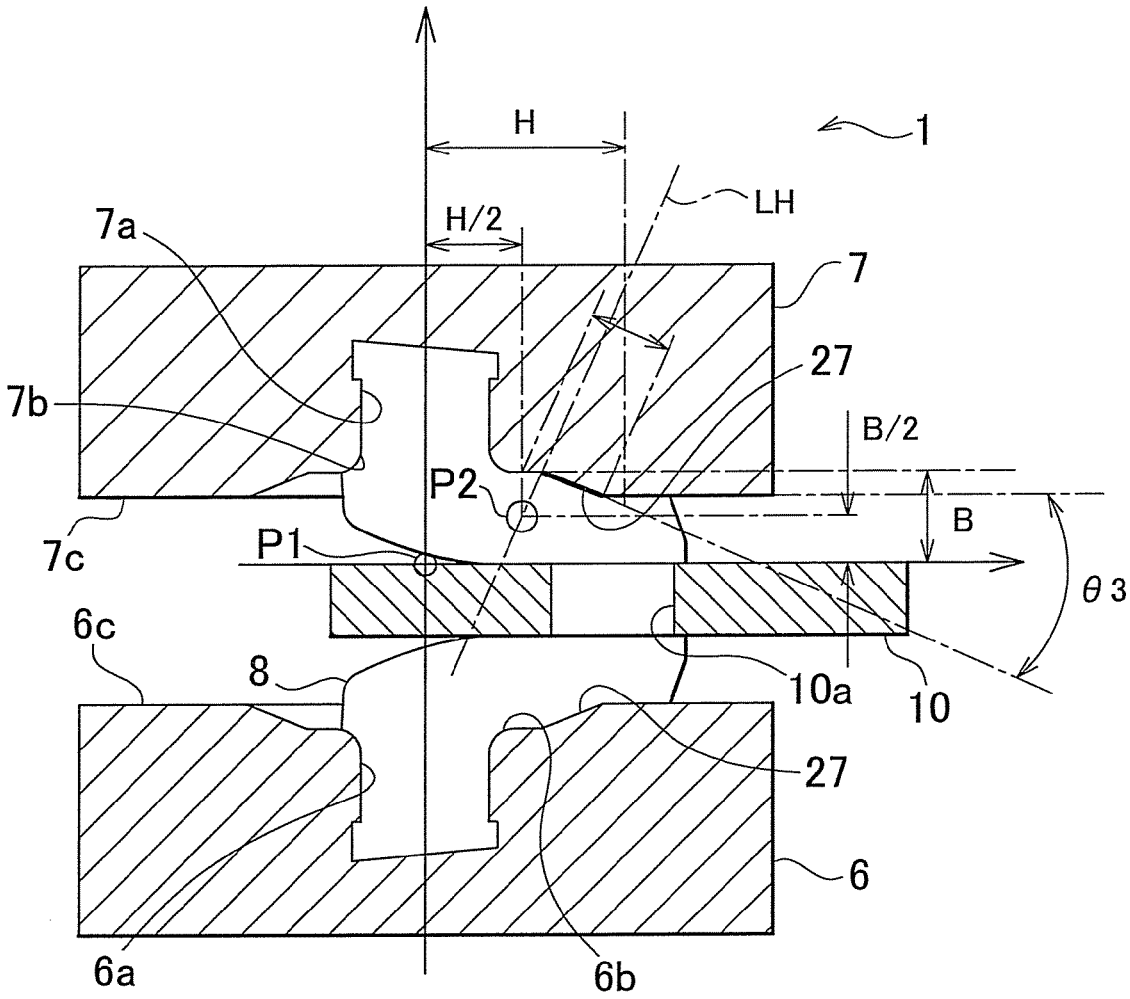
FIG. 48 is a cross-sectional view illustrating in a simple manner the production apparatus in the latter half of the swaging process in the sixth embodiment.
Figure 49:
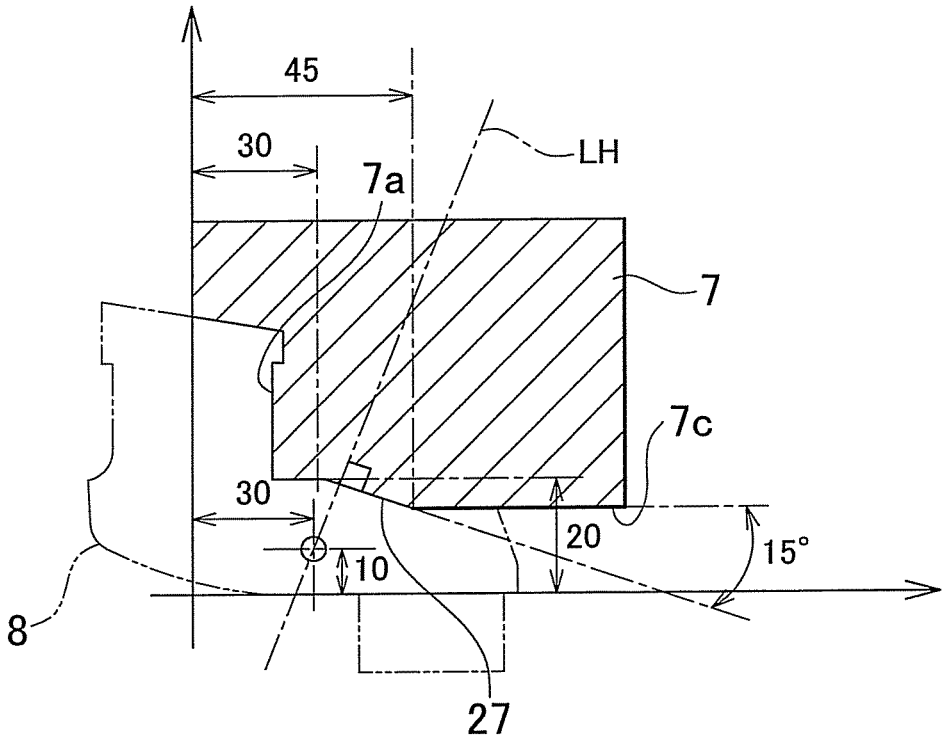
FIG. 49 is a cross-sectional view illustrating part of the pushing die for which the range of the inclined portion is stipulated by way of example by specific dimensions in the sixth embodiment.

FIG. 48 is a cross-sectional view illustrating in a simple manner the production apparatus 1 in the latter half of the swaging process in the sixth embodiment. In FIG. 48, where an amount of eccentricity (amount of displacement in the horizontal direction) of the shaft blank 8 from a virtual origin point P1 is denoted by "H" and the height from the virtual origin point P1 to the inner end of the inclined portion 27 is denoted by "B", the initiation point P2 of a shaping crack will be represented by a coordinate (H/2, B/2) with respect to the virtual origin point P1. Further, a normal line LH to the predetermined angle θ3 can take a range of the inclined portion 27 so as to cross the initiation point P2. FIG. 49 is a cross-sectional view illustrating an example of the pushing die 7 for which the range of the inclined portion 27 is stipulated by specific dimensions in the sixth embodiment.

Figure 50:
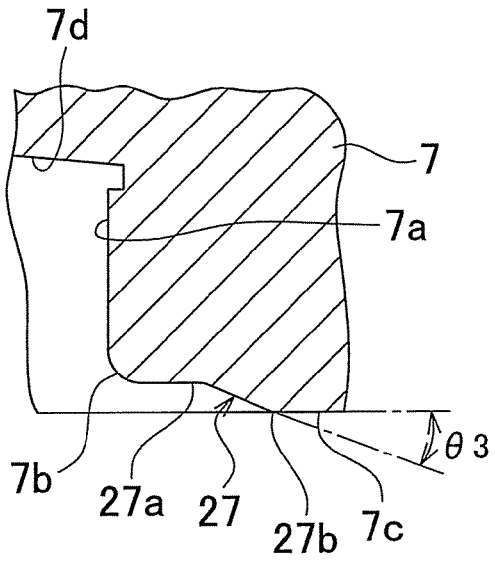
FIG. 50 is a cross-sectional view according to FIG. 46 that illustrates a variation of the inclined portion in the sixth embodiment.
Figure 51:
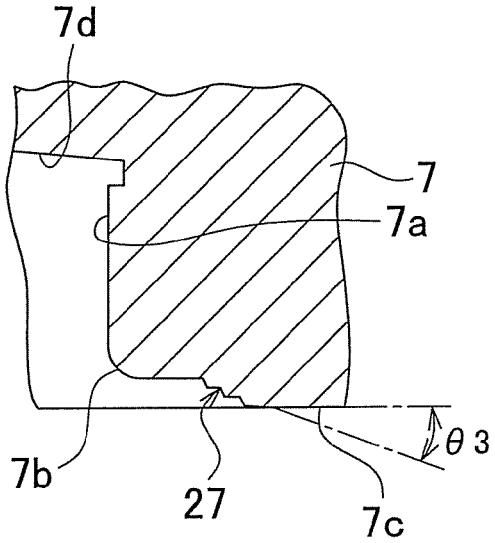
FIG. 51 is a cross-sectional view according to FIG. 46 that illustrates a variation of the inclined portion in the sixth embodiment.
Figure 52:
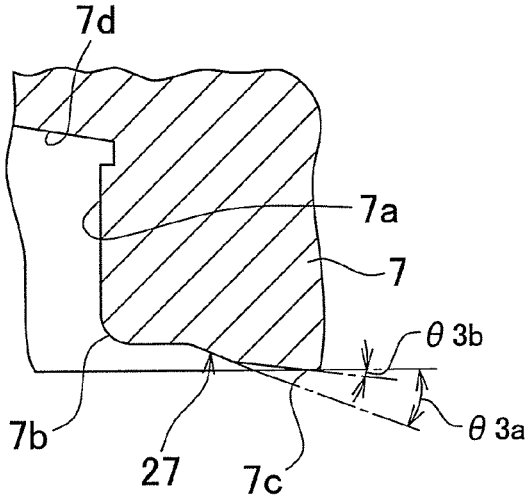
FIG. 52 is a cross-sectional view according to FIG. 46 that illustrates a variation of the inclined portion in the sixth embodiment.

As described above, the portion 26 with increased surface roughness and the inclined portion 27 are provided at the bottom surface 7*c* of the pushing die 7, but the configuration can include variation examples of the inclined portion 27 that are described below. FIGS. 50 to 52 are cross-sectional views according to FIG. 46 that illustrate variations of the inclined portion 27 in the sixth embodiment. For example, the connection zones 27*a*, 27*b* of the inclined portion 27 and the surfaces adjacent thereto can be in the form of circular arcs with a radius of about "R=10", as shown in FIG. 50, very small steps can be formed at the inclined portion 27, as shown in FIG. 51, or the inclined portion 27 can be formed as a multistage tapered surface with different inclination angles θ3*a*, θ3*b*, as shown in FIG. 52.

In the production method according to the sixth embodiment, when the surfaces of the shaft blank 8 that will be buckled are pressurized by the bottom surfaces 7*c*, 6*c* of the two dies 7, 6, because the pressurization is performed by the inclined portion 27, a compressive load is applied to the shaft blank 8 such that inhibits the slip between the end surfaces 7*c*, 6*c* of the two dies 7, 6 and the surfaces of the shaft blank 8.

Figure 53:
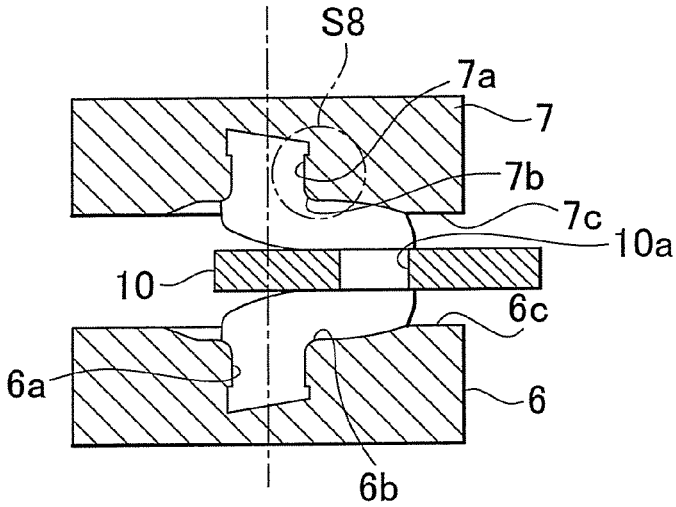
FIG. 53 is a cross-sectional view illustrating in a simple manner the production apparatus in the latter half of the eccentric swaging-process in the sixth embodiment.
Figure 54:
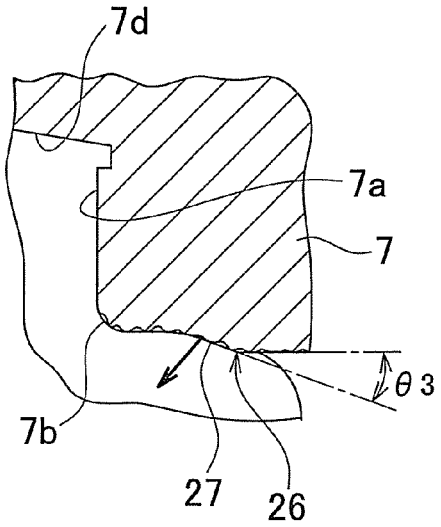
FIG. 54 is an enlarged cross-sectional view illustrating a portion shown by a dash-line circle in FIG. 53 in the sixth embodiment.

FIG. 53 is a cross-sectional view illustrating in a simple manner the production apparatus 1 in the latter half of the eccentric swaging-process in the sixth embodiment. FIG. 54 is an enlarged cross-sectional view illustrating a portion shown by a dash-line circle S8 in FIG. 53. Therefore, with the configuration of the special portions according to the sixth embodiment, as shown in FIGS. 53 and 54, because the inclined portion 27 is provided in the portion 26 with increased surface roughness; this inclined portion 27 generates a compressive load on the surface of the shaft blank 8 in the latter half of the eccentric swaging process. Thus, the pressurization with the inclined portion 27 applies a compressive load to the shaft blank 8 such that inhibits the slip between the end surfaces 7*c*, 6*c* of the two dies 7, 6 and the surfaces of the shaft blank 8. As a result, the occurrence of tensile stresses and shear stresses at the surface of the shaft blank 8 in the latter half of the eccentric swaging process is inhibited. As a consequence, shaping cracks induced in the surface of the shaft blank 8 by swaging in the eccentric swaging-forging can be inhibited.

Seventh Embodiment

The seventh specific embodiment of the crankshaft production method and production apparatus in accordance with the invention will be explained below in greater details with reference to the appended drawings.

Figure 55:
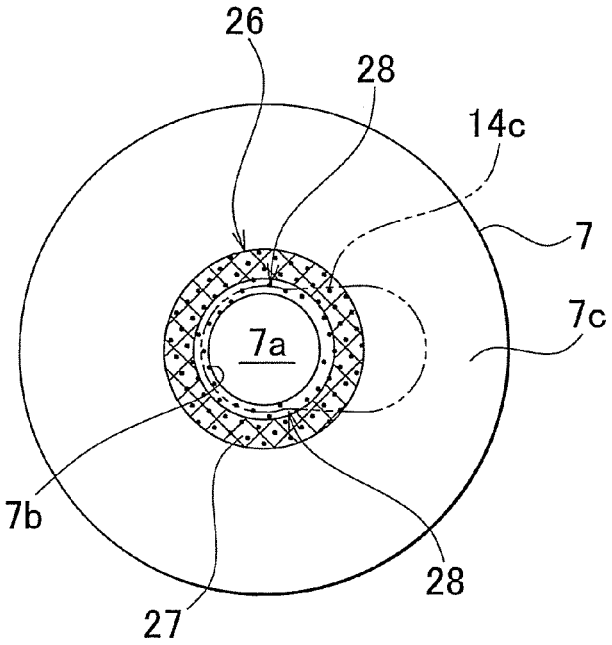
FIG. 55 is a bottom view showing a pushing die in the sixth embodiment.

FIG. 55 is a bottom view showing the pushing die 7 in the sixth embodiment. With the configuration of the special portions according to the sixth embodiment, shaping cracks CR2 in the shaft blank 8 in the latter half of the swaging process can be inhibited by providing the inclined portion 27 in the portion 26 with increased surface roughness of the bottom surface 7*c* of the pushing die 7. However, because the inclined portion 27 is formed concentrically around the receiving orifice 7*a*, the material of the shaft blank 8 can flow in the normal direction in the inclined portion 27 with the receiving orifice 7*a* as a center in swaging process of the shaft blank 8. As a result, as shown by a two-dot—dash line in FIG. 55, a neck 28 appears in part of the arm portion 14*c* that is shaped and cracking can occur from a portion of this neck 28. Accordingly, in the seventh embodiment, the form of the bottom surface 7*c* of the pushing die 7 is further improved. The fixed die 6 has the same configuration.

Figures 56A, 56B:
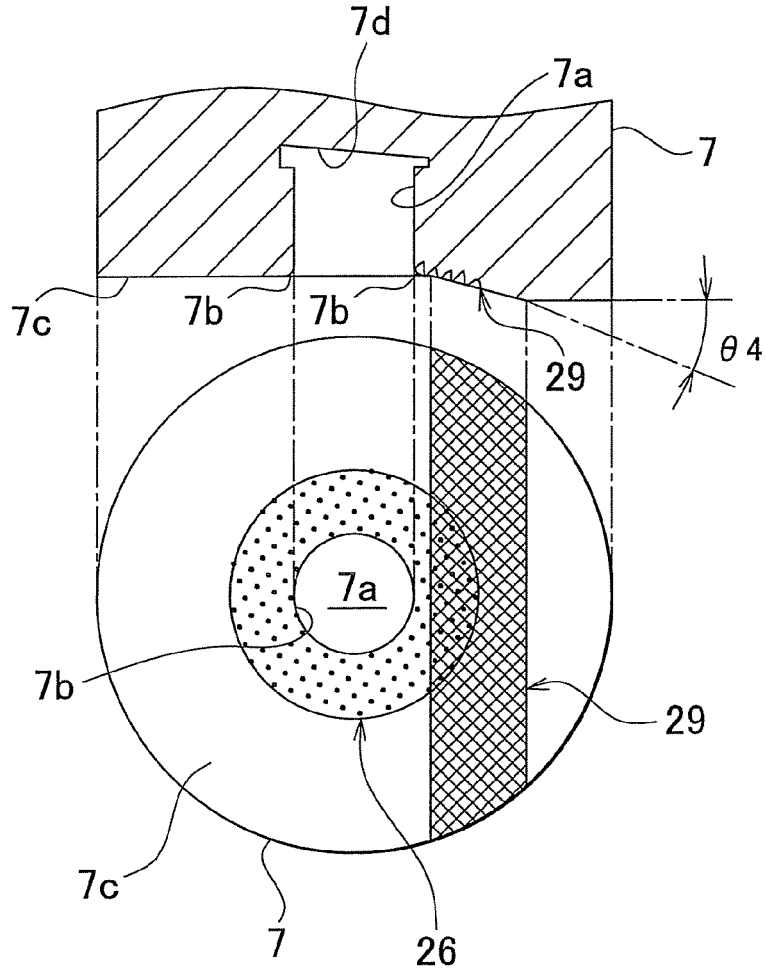
FIGS. 56A and 56B relate to the seventh embodiment.

FIGS. 56A and 56B relate to the seventh embodiment and show a side cross-sectional view illustrating the pushing die 7 and a bottom view of the pushing die 7. As shown in FIGS. 56A and 56B, in the pushing die 7 according to the seventh embodiment, a portion 26 with the increased surface roughness is provided at the opening edge 7*b* of the receiving orifice 7*a* and also at the bottom surface 7*c* continuous therewith, in the same manner as in the fifth embodiment. Further, instead of providing the inclined portion 27 concentrically around the receiving orifice 7*a*, a band-shaped inclined portion 29 (shown by a mesh in FIG. 56B) is provided at the eccentric side of the shaft blank 8 at the bottom surface 7*c* of the pushing die 7, the band-shaped inclined portion extending linearly in the direction perpendicular to the eccentric deformation direction. This inclined portion 29 has a predetermined inclination angle θ4. The inclination angle θ4 can be, for example, 5 to 30°. The inclined portion 29 is inclined so as to descend in the specific direction SD and toward the other end side of the shaft blank 8. The fixed die 6 has a similar configuration.

As variation examples of the inclined portion 29, this portion may be for lied as shown in FIGS. 50 to 52. Thus, the connection zones of the inclined portion 29 and the surfaces adjacent thereto can be in the form of circular arcs with a radius of about "R=10", as shown in FIG. 50, very small steps can be formed at the inclined portion 29, as shown in FIG. 51, or the inclined portion 29 can be formed as a multistage tapered surface, as shown in FIG. 52.

In the production method according to the seventh embodiment, when the surfaces of the shaft blank 8 that will be buckled are pressurized by the bottom surfaces 7*c*, 6*c* of the two dies 7, 6, because the pressurization is performed by the inclined portion 29, a compressive load is applied to the shaft blank 8 such that inhibits the slip between the end surfaces 7*c*, 6*c* of the two dies 7, 6 and the surfaces of the shaft blank 8.

Figure 57:
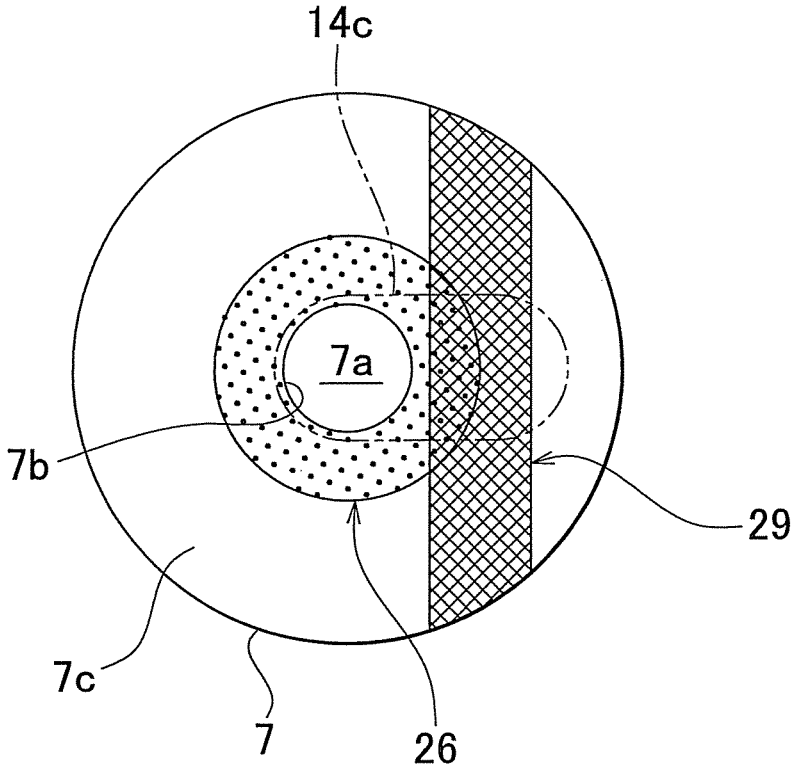
FIG. 57 is a bottom view showing a pushing die in the seventh embodiment.
Figure 58:
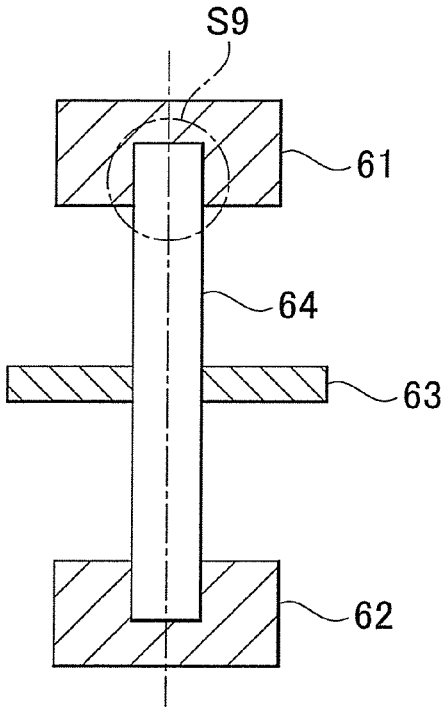
FIG. 58 RELATED ART
FIG. 58 is a cross-sectional view showing in a simple manner the production apparatus in the initial state in a conventional example.
Figure 59:
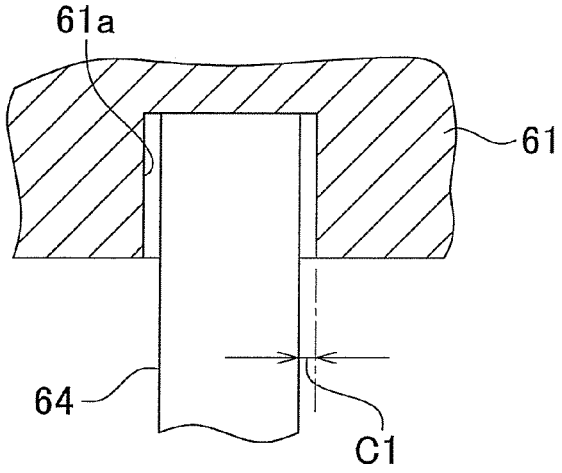
FIG. 59 RELATED ART
FIG. 59 is an enlarged cross-sectional view showing the inside of the dash-line circle shown in FIG. 58 in the conventional example.
Figure 60:
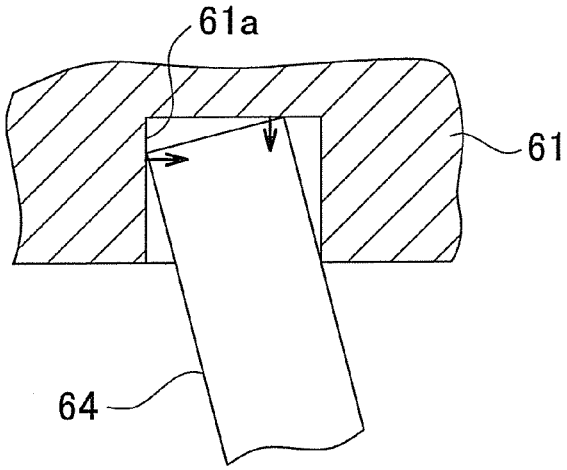
FIG. 60 RELATED ART
FIG. 60 is a cross-sectional view according to FIG. 59 that shows a state after the shaping has been started in the conventional example.
Figure 61:
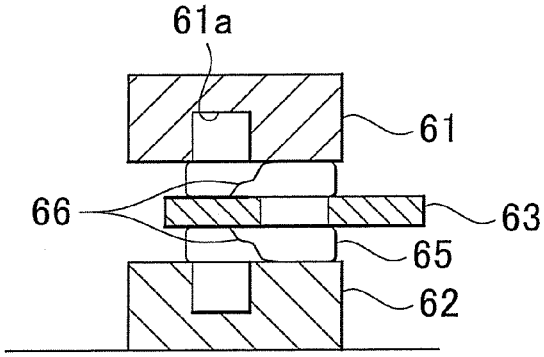
FIG. 61 RELATED ART
FIG. 61 is a cross-sectional view showing the production apparatus after shaping in the conventional example.

FIG. 57 shows the pushing die 7 in the form of a bottom view. Therefore, with the configuration of special portions according to the seventh embodiment, the flow of material of the shaft blank 8 becomes parallel to the buckling (eccentric deformation) direction because of the portion 26 with the increased surface roughness and the inclined portion 29, and the necking can hardly occur in the arm portion 14*c*. As a result, the occurrence of shaping cracks in the arm portion 14*c* can be inhibited.

The invention is not limited to the above-described embodiments and some of the features can be appropriately modified without departing from the essence of the invention.

For example, the configurations of the holding member and movement restricting portion according to the invention that are described in the embodiments are exemplary and the invention is not limited to these configurations.

What is claimed is:

1. A crankshaft production apparatus comprising:

a first die that applies a compressive load to a shaft blank in a longitudinal direction of the shaft blank, is provided at one end side of the shaft blank, and includes a pressurization surface that pressurizes an end surface of the shaft blank, wherein the pressurization surface is inclined by a predetermined inclination angle in a single direction toward a buckling direction of the shaft blank, wherein the buckling direction of the shaft blank is substantially perpendicular to the longitudinal direction of the shaft blank;

a second die that applies a compressive load to the shaft blank in the longitudinal direction of the shaft blank, is provided at another end side of the shaft blank opposed to the one end side, and includes a pressurization surface that pressurizes the other end surface of the shaft blank, wherein the pressurization surface is inclined by a predetermined inclination angle in a single direction toward the buckling direction of the shaft blank;

a third die installed on the shaft blank;

a holding member that holds the third die in a predetermined zone on the shaft blank; and movement restricting portion that restricts a movement of the holding member in a radial direction of the shaft blank together with the third die, in a direction other than the buckling direction.

2. The production apparatus according to claim 1, wherein the first die and the second die each include a receiving orifice that receives an end portion of the shaft blank, the inclined pressurization surface is formed in a bottom portion of the receiving orifice facing the other die respectively, and a circumferential groove is foamed along a circumference of the bottom portion.

3. The production apparatus according to claim 1, wherein the first die and the second die each include a receiving orifice that receives an end portion of the shaft blank, and an opening edge of the receiving orifice is formed in a circular arc shape.

4. A crankshaft production apparatus comprising:

a first die that applies a compressive load to a shaft blank in a longitudinal direction of the shaft blank, is provided at one end side of the shaft blank, and includes an inclined portion that is provided in at least part of a pressing surface thereof and is inclined by a predetermined inclination angle in a single direction toward a buckling direction of the shaft blank, wherein the buckling direction of the shaft blank is substantially perpendicular to the longitudinal direction of the shaft blank;

a second die that applies a compressive load to the shaft blank in a longitudinal direction of the shaft blank, is provided at another end side of the shaft blank opposed to the one end side, and includes an inclined portion that is provided in at least part of a pressing surface thereof and is inclined by a predetermined inclination angle in a single direction toward the buckling direction of the shaft blank;

a third die installed on the shaft blank;

a holding member that holds the third die in a predetermined zone on the shaft blank; and movement restricting portion that restricts a movement of the holding member in a radial direction of the shaft blank together with the third die, in a direction other than the buckling direction.

5. The production apparatus according to claim 4, wherein the first die and the second die each include a receiving orifice that receives an end portion of the shaft blank, and a portion with increased surface roughness is provided at the bottom surface of each of the first die and the second die concentrically around the receiving orifice, the increased surface roughness of the portion being sufficient to inhibit slipping of the shaft blank against the portion.

* * * * *

UNITED STATES PATENT AND TRADEMARK OFFICE

CERTIFICATE OF CORRECTION

PATENT NO. : 8,667,828 B2
APPLICATION NO. : 12/689412
DATED : March 11, 2014
INVENTOR(S) : O. Maeda et al.

It is certified that error appears in the above-identified patent and that said Letters Patent is hereby corrected as shown below:

In the Specification

At column 1, line 25, change “budded” to -- buckled --.

At column 2, line 33, change “budding” to -- buckling --.

At column 5, line 4, change “budded” to -- buckled --.

At column 15, line 45, change “R > D * 0.04” to -- R ≥ D * 0.04 --.

Signed and Sealed this
Sixteenth Day of September, 2014

Michelle K. Lee

Michelle K. Lee
*Deputy Director of the United States Patent and Trademark Office*